US008548186B2

(12) United States Patent
Alwicker et al.

(10) Patent No.: US 8,548,186 B2
(45) Date of Patent: Oct. 1, 2013

(54) EARPHONE ASSEMBLY

(75) Inventors: Michael Joseph Alwicker, Chicago, IL (US); John P. Devlin, Tewksbury, MA (US); Mark Bui Breneman, Boston, MA (US)

(73) Assignee: Shure Acquisition Holdings, Inc., Niles, IL (US)

( * ) Notice: Subject to any disclaimer, the term of this patent is extended or adjusted under 35 U.S.C. 154(b) by 523 days.

(21) Appl. No.: 12/833,651

(22) Filed: Jul. 9, 2010

(65) Prior Publication Data

US 2012/0008814 A1 Jan. 12, 2012

(51) Int. Cl.
*H04R 25/00* (2006.01)

(52) U.S. Cl.
USPC ..... 381/371

(58) Field of Classification Search
USPC ..... 381/371
See application file for complete search history.

(56) References Cited

U.S. PATENT DOCUMENTS

| | | | |
|---|---|---|---|
| 2,325,590 | A | 8/1943 | Carlisle |
| 2,430,229 | A | 11/1947 | Kelsey |
| 2,521,414 | A | 9/1950 | Schier |
| 2,808,468 | A | 10/1957 | Knauert |
| 2,971,065 | A | 2/1961 | Busse |
| 3,068,954 | A | 12/1962 | Strzalkowski |
| 3,265,819 | A | 8/1966 | Herrmann |
| 3,312,789 | A | 4/1967 | Lewis |
| 3,374,318 | A | 3/1968 | Martin |
| 3,529,102 | A | 9/1970 | Rosenstand |
| 4,295,066 | A | 10/1981 | Lloyd |
| 4,311,206 | A | 1/1982 | Johnson |
| 4,375,016 | A | 2/1983 | Harada |
| 4,407,389 | A | 10/1983 | Johnson |
| 4,418,787 | A | 12/1983 | Eggert et al. |
| 4,420,657 | A | 12/1983 | Larkin |
| 4,443,668 | A | 4/1984 | Warren |
| 4,473,722 | A | 9/1984 | Wilton |
| 4,520,236 | A | 5/1985 | Gauthier |
| 4,532,649 | A | 7/1985 | Bellafiore |
| 4,592,370 | A | 6/1986 | Lee et al. |

(Continued)

FOREIGN PATENT DOCUMENTS

| | | |
|---|---|---|
| DE | 2923865 | 11/1980 |
| DE | 3504891 | 9/1985 |

(Continued)

OTHER PUBLICATIONS

International Search Report and Written Opinion for PCT/US2011/042575, dated Sep. 20, 2011, 11 pages.

(Continued)

*Primary Examiner* — Jeffrey Donels
(74) *Attorney, Agent, or Firm* — Banner & Witcoff, Ltd.

(57) ABSTRACT

An earphone assembly for an in-ear listening device is disclosed. The earphone assembly has an inner housing comprising a nozzle, configured to receive a sleeve for placement into a user's ear, and a balanced armature motor assembly. The balanced armature motor assembly is mounted in the inner housing so as to form an acoustical seal between the inner housing and the balanced armature motor assembly. The earphone assembly also includes an outer housing configured to receive the inner housing. The inner housing can comprise a recess for receiving a paddle of the balanced armature motor assembly. Alternatively, the outer housing can be formed with a nozzle for receiving a sleeve for placement into a user's ear canal, and the inner housing can comprise a spout, which is received in a recess in the outer housing.

22 Claims, 24 Drawing Sheets

(56) References Cited

U.S. PATENT DOCUMENTS

| | | | |
|---|---|---|---|
| 4,607,720 | A | 8/1986 | Hardt |
| 4,677,408 | A | 6/1987 | Bastian |
| 4,706,778 | A | 11/1987 | Topholm |
| 4,867,267 | A | 9/1989 | Carlson |
| 4,870,688 | A | 9/1989 | Voroba |
| 4,870,689 | A | 9/1989 | Weiss |
| 4,879,750 | A | 11/1989 | Nassler |
| 4,956,868 | A | 9/1990 | Carlson |
| 4,969,534 | A | 11/1990 | Kolpe |
| 4,987,597 | A | 1/1991 | Haertl |
| 5,002,151 | A | 3/1991 | Oliveira |
| 5,048,092 | A | 9/1991 | Yamagishi |
| 5,068,901 | A | 11/1991 | Carlson |
| 5,131,128 | A | 7/1992 | Bisgaard |
| 5,193,116 | A | 3/1993 | Mostardo |
| 5,220,612 | A | 6/1993 | Tibbetts et al. |
| 5,299,176 | A | 3/1994 | Tibbetts |
| 5,319,163 | A | 6/1994 | Scott |
| 5,327,506 | A | 7/1994 | Stites |
| 5,390,254 | A | 2/1995 | Adelman |
| D360,691 | S | 7/1995 | Mostardo |
| D360,948 | S | 8/1995 | Mostardo |
| D360,949 | S | 8/1995 | Mostardo |
| D377,796 | S | 2/1997 | Hayashi |
| 5,610,989 | A | 3/1997 | Salvage |
| 5,647,013 | A | 7/1997 | Salvage |
| 5,655,026 | A | 8/1997 | Peters |
| 5,659,620 | A | 8/1997 | Kuhlman |
| 5,661,420 | A | 8/1997 | Killion |
| 5,682,020 | A | 10/1997 | Oliveira |
| 5,687,244 | A | 11/1997 | Untersander |
| 5,692,059 | A | 11/1997 | Kruger |
| 5,708,721 | A | 1/1998 | Salvage |
| 5,721,783 | A | 2/1998 | Anderson |
| 5,753,870 | A | 5/1998 | Schlaegel |
| 5,757,947 | A | 5/1998 | Van Halteren |
| 5,784,471 | A | 7/1998 | Bebenroth |
| 5,809,158 | A | 9/1998 | Van Halteren |
| 5,887,070 | A | 3/1999 | Iseberg |
| 5,960,093 | A | 9/1999 | Miller |
| 6,041,131 | A | 3/2000 | Kirchhoefer |
| 6,078,677 | A | 6/2000 | Dolleman et al. |
| 6,137,889 | A | 10/2000 | Shennib |
| 6,205,227 | B1 | 3/2001 | Mahoney |
| D453,119 | S | 1/2002 | Tsuchikiri |
| 6,347,149 | B1 | 2/2002 | Bachmann |
| D468,299 | S | 1/2003 | Boesen |
| D468,300 | S | 1/2003 | Boesen |
| D468,301 | S | 1/2003 | Fushimi |
| 6,563,933 | B1 | 5/2003 | Niederdraenk |
| 6,658,134 | B1 | 12/2003 | Van Hal |
| 6,727,789 | B2 | 4/2004 | Tibbetts |
| D490,399 | S | 5/2004 | Kamo |
| 6,757,403 | B2 | 6/2004 | Urushibata et al. |
| 6,853,735 | B2 | 2/2005 | Imahori et al. |
| 6,909,613 | B2 | 6/2005 | Augustijn et al. |
| 6,931,142 | B2 | 8/2005 | Fushimi |
| 7,024,010 | B2 | 4/2006 | Saunders |
| 7,050,602 | B2 | 5/2006 | Miller |
| 7,088,839 | B2 | 8/2006 | Geschiere |
| 7,103,196 | B2 | 9/2006 | Warren |
| 7,110,565 | B1 | 9/2006 | Engbert |
| 7,164,776 | B2 | 1/2007 | Miller |
| 7,190,803 | B2 | 3/2007 | Van Halteren |
| 7,194,102 | B2 | 3/2007 | Harvey |
| 7,194,103 | B2 | 3/2007 | Harvey |
| 7,206,425 | B2 | 4/2007 | Vaudrey |
| 7,206,428 | B2 | 4/2007 | Geschiere |
| 7,236,609 | B1 | 6/2007 | Tsangaris |
| 7,263,195 | B2 | 8/2007 | Harvey |
| 7,317,806 | B2 | 1/2008 | Harvey |
| 7,321,664 | B2 | 1/2008 | Van Banning |
| 7,336,797 | B2 | 2/2008 | Thompson |
| D567,217 | S | 4/2008 | Kamo |
| 7,362,878 | B2 | 4/2008 | Miller |
| 7,412,763 | B2 | 8/2008 | Jiles |
| 7,415,125 | B2 | 8/2008 | Warren |
| 7,489,794 | B2 | 2/2009 | Harvey |
| 7,492,919 | B2 | 2/2009 | Engbert |
| 7,529,379 | B2 | 5/2009 | Zurek |
| 7,551,748 | B2 | 6/2009 | Kamo |
| 2004/0151334 | A1 | 8/2004 | Vaudrey |
| 2006/0034480 | A1 | 2/2006 | Simidian |
| 2006/0153418 | A1 | 7/2006 | Van Halteren |
| 2007/0189569 | A1 | 8/2007 | Haapapuro |
| 2007/0201717 | A1 | 8/2007 | Dyer |
| 2007/0258616 | A1 | 11/2007 | Tsangaris |
| 2007/0274558 | A1 | 11/2007 | Lyon |
| 2007/0291971 | A1 | 12/2007 | Halteren |
| 2008/0019555 | A1 | 1/2008 | Llamas-Young |
| 2008/0181443 | A1 | 7/2008 | Harvey |
| 2008/0240485 | A1 | 10/2008 | Dyer |
| 2009/0028356 | A1 | 1/2009 | Ambrose |
| 2009/0041262 | A1 | 2/2009 | Harvey |
| 2009/0060245 | A1 | 3/2009 | Blanchard |
| 2009/0116677 | A1 | 5/2009 | Jones |
| 2009/0147981 | A1 | 6/2009 | Blanchard |
| 2009/0232341 | A1 | 9/2009 | Pinter |

FOREIGN PATENT DOCUMENTS

| | | |
|---|---|---|
| GB | 1032548 | 6/1966 |
| GB | 2155276 | 9/1985 |
| GB | 2197158 | 5/1988 |
| GB | 2453434 | 8/2009 |
| NL | 7613904 | 6/1978 |
| WO | 9507014 | 3/1995 |
| WO | 0169963 | 9/2001 |
| WO | 2007038671 | 4/2007 |

OTHER PUBLICATIONS

"Headphones," dated Aug. 21, 2007, retrieved from http://en.wikipedia.org/wiki/Headhpones, retrieved on Sep. 15, 2011, 11 pages.

"Balanced Armature," dated Aug. 21, 2007, retrieved from http://en.wikipedia.org/wiki/File"Bal_Arm.JPG, retrieved on Sep. 15, 2011, 4 pages.

EARPHONE ASSEMBLY

TECHNICAL FIELD

The disclosure herein relates to the field of sound reproduction, more specifically to the field of sound reproduction using an earphone. Aspects of the disclosure relate to earphones for in-ear listening devices ranging from hearing aids to high quality audio listening devices to consumer listening devices.

BACKGROUND

Personal "in-ear" monitoring systems are utilized by musicians, recording studio engineers, and live sound engineers to monitor performances on stage and in the recording studio. In-ear systems deliver a music mix directly to the musician's or engineer's ears without competing with other stage or studio sounds. These systems provide the musician or engineer with increased control over the balance and volume of instruments and tracks, and serve to protect the musician's or engineer's hearing through better sound quality at a lower volume setting. In-ear monitoring systems offer an improved alternative to conventional floor wedges or speakers, and in turn, have significantly changed the way musicians and sound engineers work on stage and in the studio.

Moreover, many consumers desire high quality audio sound, whether they are listening to music, DVD soundtracks, podcasts, or mobile telephone conversations. Users may desire small earphones that effectively block background ambient sounds from the user's outside environment.

Hearing aids, in-ear systems, and consumer listening devices typically utilize earphones that are engaged at least partially inside of the ear of the listener. Typical earphones have one or more drivers or balanced armatures mounted within a housing. Typically, sound is conveyed from the output of the driver(s) through a cylindrical sound port or a nozzle.

FIGS. 1A and 1B show a prior-art balanced armature driver 10 used in hearing aids, in-ear monitors ("IEMs"), audiometric tools, and consumer earphones. A metal case 12 (for example, mu-metal) is used for shielding the motor 50, the paddle 52, and the diaphragm support 54 of the armature. A top cup or lid 14 and a bottom cup or can 16 together form the metal case 12. In applications seen in the art, a sound entry tube 18 must attach to a secondary or multiple outlet paths (ultimately to get to the ear) without any acoustic leaks. Acoustic leaks cause the sound quality to degrade, especially at low frequencies. The methods of sealing the sound entry tube to the secondary outlet paths are typically accomplished using tubes, elastomeric molds, adhesives, Poron (compressible visco-elastic reticulated foam), or combinations thereof.

Additionally, the bottom cup or can 16 acts as the base part of the assembly such that all above components are built into it. Although this is a feasible manufacturing method and may be used in conjunction with the present disclosure, there is less "open processing surface" or area to assemble the components for this type of base part (a box with an open top). Having an "open processing surface" makes line of sight checking of fit and alignment of mating features via human eye or camera more feasible.

A prior art earphone assembly 100 is shown in FIG. 2. A first cover portion 102A and a second cover portion 102B form a housing for the internal components of the earphone. The housing contains a first balanced armature driver 104A and a second balanced armature driver 104B, a nozzle 112, and a coupling 118 for receiving a cable 116. The nozzle 112 mates with a sleeve 114, which is inserted into a user's ear. The cable 116 sends an audio signal to the drivers 104A, 104B, which create sound and output the sound into the nozzle 112. The nozzle 112 projects the sound directly into a user's ear canal.

The balanced armature drivers 104A, 104B are held in place inside the first cover portion 102A and the second cover portion 102B by a set of ribs 106 located on the second cover portion 102B, a Poron seal 110, and a molded thermoplastic elastomer ("TPE") seal 108. The ribs 106 act to press the drivers 104A, 104B up against the Poron seal 110 and the TPE seal 108. The Poron seal 110 and the TPE seal 108 provide an acoustic seal between the nozzle 112 and the drivers 104A, 104B.

BRIEF SUMMARY

The present disclosure contemplates earphone driver assemblies. The following presents a simplified summary of the disclosure in order to provide a basic understanding of some aspects. It is not intended to identify key or critical elements of the invention or to delineate the scope of the invention. The following summary merely presents some concepts of the disclosure in a simplified form as a prelude to the more detailed description provided below. For example, the present disclosure could be implemented in or in conjunction with the earphone assemblies, drivers, and methods disclosed in Ser. No. 12/833,683, titled "Earphone Driver and Method of Manufacture" and Ser. No. 12/833,639, titled "Drive Pin Forming Method and Assembly for a Transducer," which are herein incorporated fully by reference.

In an exemplary embodiment an earphone assembly has an inner housing comprising a nozzle, configured to receive a sleeve for placement into a user's ear, and a balanced armature motor assembly. The balanced armature motor assembly is mounted in the inner housing so as to form an acoustical seal between the inner housing and the balanced armature motor assembly. The earphone assembly also includes an outer housing configured to receive the inner housing, and the nozzle of the inner housing extends through the outer housing. The inner housing can comprise a recess for receiving a paddle and at least one notch portion for receiving the pole piece. The inner housing may comprise a nozzle base and a cover. Alternatively one of the nozzle base or cover comprises a cavity housing the balanced armature motor assembly.

In another exemplary embodiment the balanced armature motor assembly can comprise an armature, a pole piece containing an upper magnet and a lower magnet, a bobbin surrounded by a coil, a flex board mounted to the bobbin, and a drive pin, and the drive pin can be operatively connected to a paddle.

In another exemplary embodiment an earphone assembly comprises an inner housing comprising a balanced armature motor assembly and an outer housing comprising a nozzle configured to receive a sleeve for placement into a user's ear. At least a portion of the inner housing is integrally formed together with the outer housing. The inner housing may comprise both a base portion formed together with the outer housing and an inner cover portion formed together with the outer housing. Alternatively the inner housing may comprise a lid configured to be secured to the portion of the inner housing formed together with the outer housing.

In another exemplary embodiment the earphone assembly comprises an inner housing containing a balanced armature motor assembly. The balanced armature motor assembly comprises a paddle, and the paddle is acoustically sealed inside the inner housing. The inner housing comprises a spout with a sound outlet. The earphone assembly also comprises an outer housing having a nozzle for transmitting sound, and an internal recess proximate the nozzle. The nozzle receives a sleeve adapted for placement into an ear canal of a user, and the internal recess receives the spout of the inner housing to form an acoustical seal between the spout and the nozzle. The spout on the inner housing comprises a recessed portion, which receives an o-ring. The internal recess can comprise a counterbore for receiving the spout and the o-ring. When the spout and the o-ring are placed into the internal recess in the nozzle, radial forces act on the o-ring to maintain the acoustical seal between the spout and the outer housing. The spout and the nozzle form a continuous acoustically-sealed sound passage to a user's ear canal.

In another exemplary embodiment a method of forming an earphone assembly comprises joining an inner cover portion with a spout base portion having a spout to form an inner housing for housing a balanced armature motor assembly, placing an o-ring onto the spout of the spout base portion, placing at least a portion of the spout and the o-ring into an recess in a primary case portion, the primary case portion comprising a nozzle extending from the recess, the o-ring forming an acoustical seal between the spout and the nozzle, and sealing an outer cover onto the primary case portion to form an outer housing. The outer housing containing the inner housing. The method further comprises forming the spout with a recessed portion and placing the o-ring in the recessed portion, acoustically sealing a paddle to the spout base portion of the inner housing, and placing a sleeve onto the nozzle for placement into an ear canal of a user.

BRIEF DESCRIPTION OF THE DRAWINGS

The present disclosure is illustrated by way of example and not limited in the accompanying figures.

DETAILED DESCRIPTION OF THE INVENTION

Figure 3:
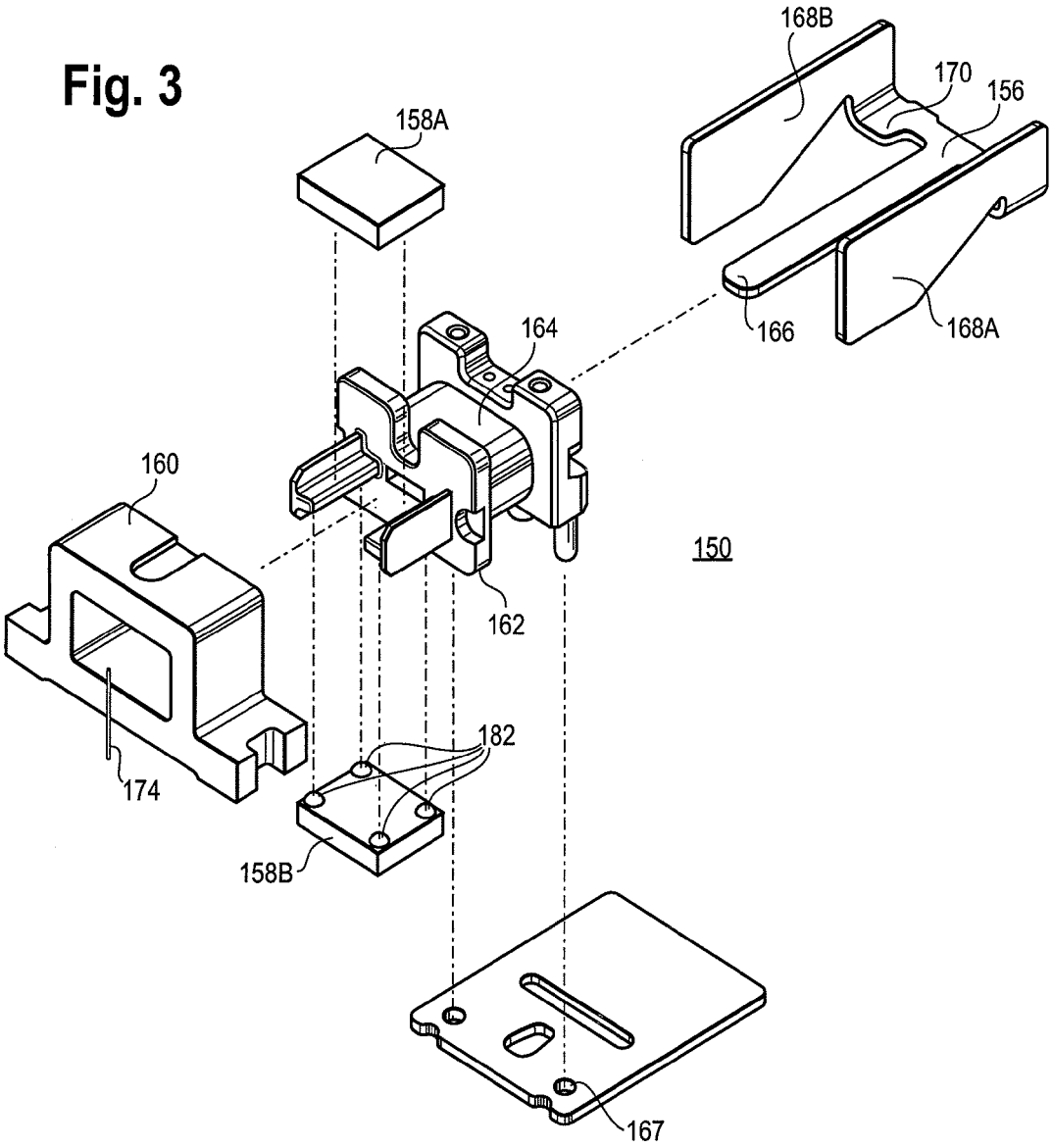
FIG. 3 depicts an exploded view of a balanced armature motor assembly.
Figure 4:
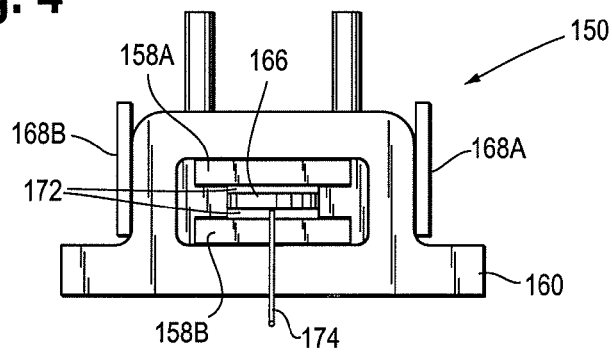
FIG. 4 depicts a front view of a balanced armature motor assembly.

Shown in FIGS. 3 and 4, is a balanced armature motor assembly, which generally consists of an armature 156, upper and lower magnets 158A, 158B, a pole piece 160, a bobbin 162, a coil 164, a drive pin 174, and a flex board 167. The magnets 158A, 158B can be secured to the pole piece 160 by one or more welds made between the magnets 158A, 158B and pole piece 160 while the magnets 158A, 158B are held into place by one or more glue dots 182. The flex board 167 is a flexible printed circuit board that mounts to the bobbin 162 and the free ends of the wire forming the coil 164 are secured to the flex board 167.

The armature 156 is generally E-shaped from a top view. In other embodiments, however, the armature 156 may have a U-shape or any other known, suitable shape. The armature has a flexible metal reed 166 which extends through the bobbin 162 and the coil 164 between the upper and lower magnets 158A, 158B. The armature 156 also has two outer legs 168A, 168B, lying generally parallel with each other and interconnected at one end by a connecting part 170. As illustrated in FIG. 4, the reed 166 is positioned within an air gap 172 formed by the magnets 158A, 158B. The two outer armature legs 168A and 168B extend along the outer side along the bobbin 162, coil 164, and pole piece 160. The two outer armature legs 168A and 168B are affixed to the pole piece 160. The reed 166 can be connected to any paddle discussed herein, such as a paddle 252, shown in FIG. 5, with the drive pin 174. The drive pin 174 can be formed of stainless steel wire or any other known suitable material.

The electrical input signal is routed to the flex board 167 via a signal cable comprised of two conductors. Each conductor is terminated via a soldered connection to its respective pad on the flex board 167. Each of these pads is electrically connected to a corresponding lead on each end of the coil 164. When signal current flows through the signal cable and into the coil's 164 windings, magnetic flux is induced into the soft magnetic reed 166 around which the coil 164 is wound. The signal current polarity determines the polarity of the magnetic flux induced in the reed 166. The free end of the reed is suspended between the two permanent magnets 158A, 158B. The magnetic axes of these two permanent magnets are both aligned perpendicular to the lengthwise axis of the reed 166. The lower face of the upper magnet 158A acts as a magnetic south pole while the upper face of the lower magnet 158B acts as a magnetic north pole.

As the input signal current oscillates between positive and negative polarity, the free end of the reed 166 oscillates its behavior between that of a magnetic north pole and south pole, respectively. When acting as a magnetic north pole, the free end of the reed 166 repels from the north-pole face of the lower magnet and attracts to the south-pole face of the upper magnet. As the free end of the reed oscillates between north and south pole behavior, its physical location in the air gap 172 oscillates in kind, thus mirroring the waveform of the electrical input signal. The motion of the reed 166 by itself functions as an extremely inefficient acoustic radiator due to its minimal surface area and lack of an acoustic seal between its front and rear surfaces. In order to improve the acoustic efficiency of the motor, the drive pin 174 is utilized to couple the mechanical motion of the free end of the reed to an acoustically sealed, lightweight paddle 152 of significantly larger surface area. The resulting acoustic volume velocity is then transmitted through the earphone nozzle 212 and ultimately into the user's ear canal, thus completing the transduction of the electrical input signal into the acoustical energy detected by the user.

Figure 5:
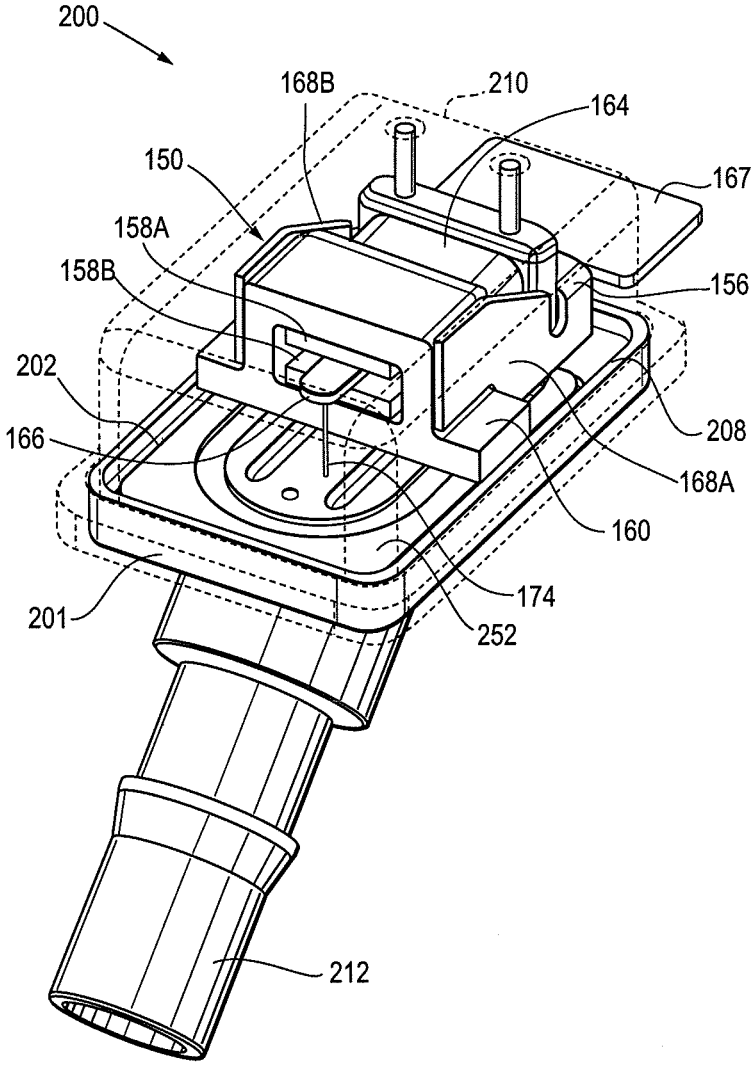
FIG. 5 depicts a front perspective view of an embodiment of an earphone assembly.

FIGS. 5-9 depict an exemplary embodiment of a balanced armature driver motor built into, or formed integral with the nozzle assembly 200. As shown in FIG. 5 the balanced armature motor assembly 150 is built into the nozzle base 201. The nozzle base 201 is formed of a molded material, which may be rigid or somewhat resilient. The nozzle base 201 provides locating, mating, and resting features for subsequent sub-assemblies such as the paddle 252 and motor assembly 150 that mate to the nozzle base 201. A nozzle 212 is integrally formed with and projects from the nozzle base 201. The motor assembly 150 with the components discussed above mounts to a shelf 202 in the nozzle base 201. An outer rim 208 of the nozzle base 201 receives a cover 210 also formed of a molded material to form an inner housing. The inner housing can then be encased by an outer housing (not shown). The cover 210 can be secured to the outer rim 208 using any appropriate known method, such as gluing, mechanically fastened with clips, screws, mating parts, or snap-fit, etc.

Figure 6:
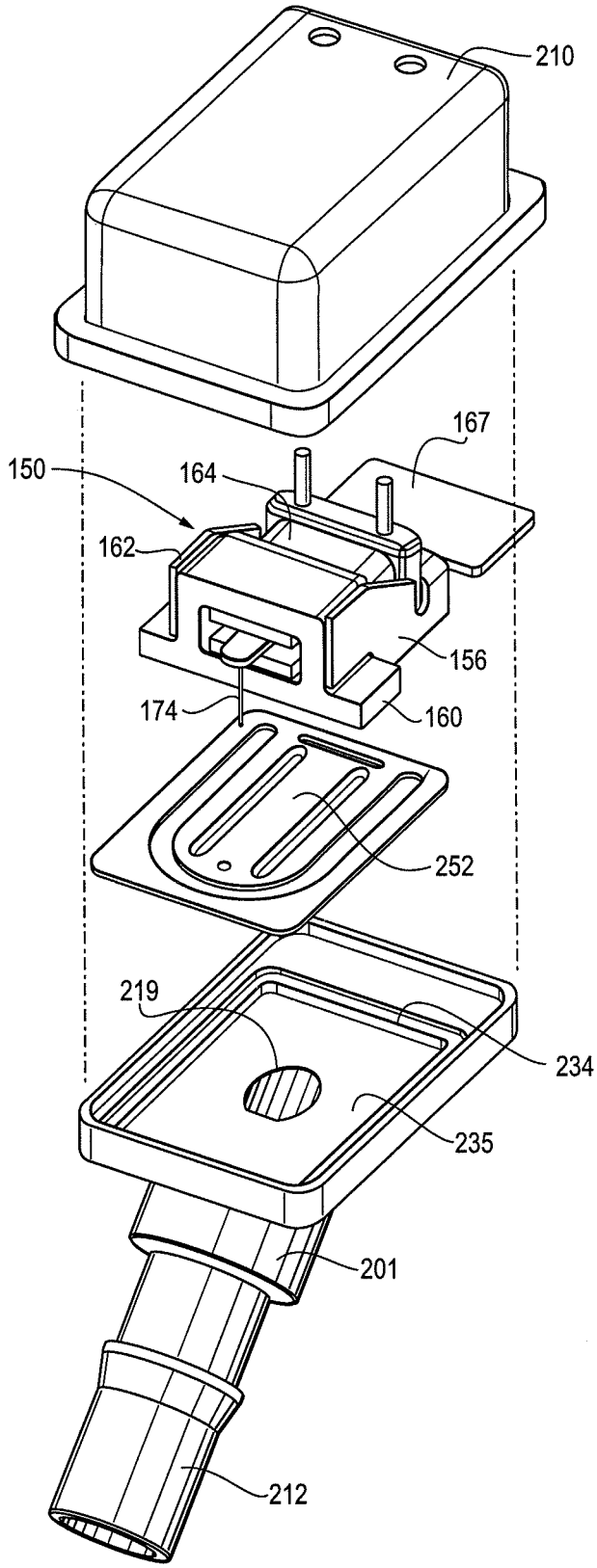
FIG. 6 depicts an exploded view of the embodiment shown in FIG. 5.
Figure 7:
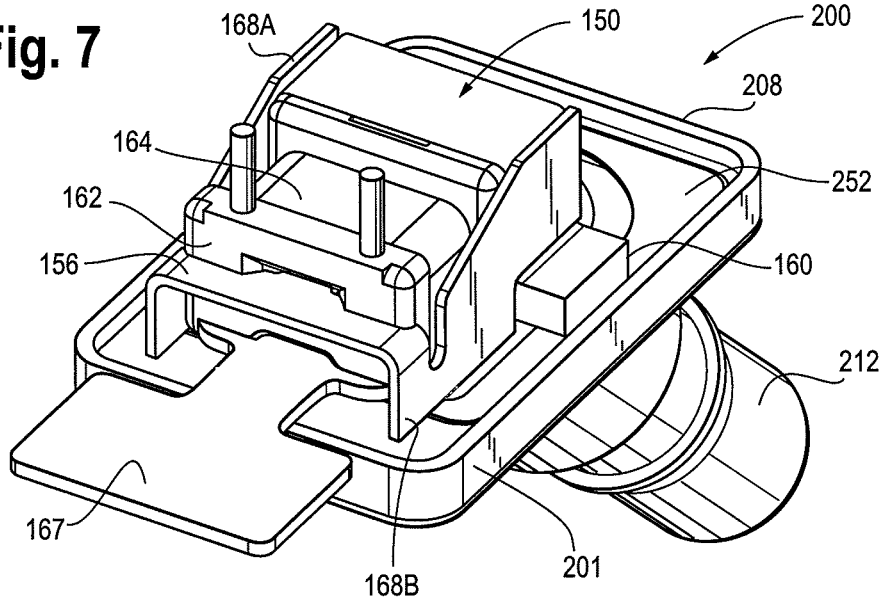
FIG. 7 depicts a rear perspective view of the embodiment shown in FIG. 5.
Figure 8:
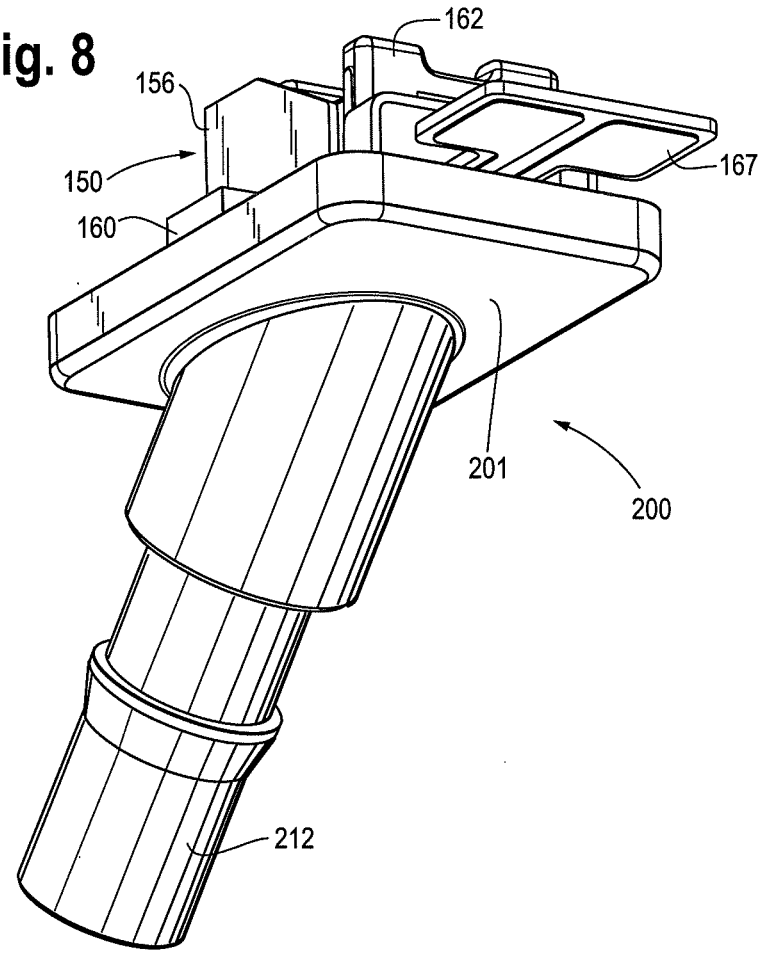
FIG. 8 depicts another rear perspective view of the embodiment shown in FIG. 5.
Figure 9:
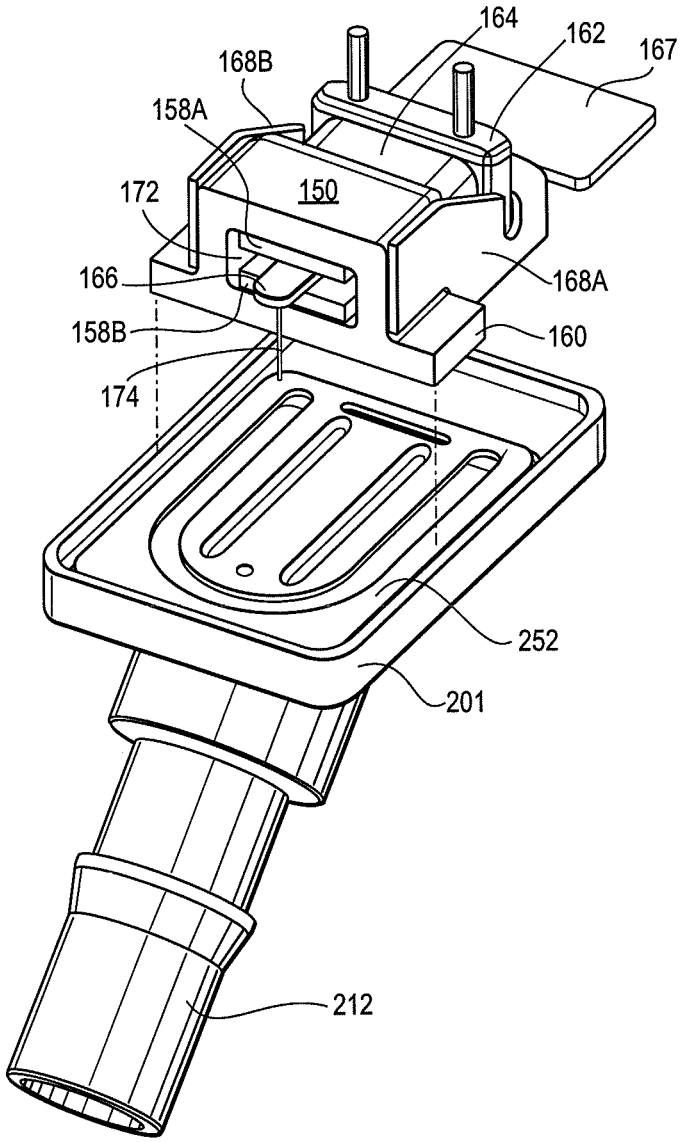
FIG. 9 depicts an exploded front perspective view of the embodiment shown in FIG. 5.

As shown in FIG. 6, the nozzle base 201 is formed with a cutout or reservoir 234 for receiving the paddle 252 and has mating features for the pole piece 160 and the armature 156. Inside the recess the nozzle base comprises a substantially flat panel. A cavity 235 forms a portion of a front acoustic cavity in the transducer. Additionally, the underside of the cover 210 forms a rear acoustic cavity in the transducer. The oscillation of the reed 166 through the drive pin 174 causes the paddle 252 to vibrate creating sound, which travels through port 219, shown in FIG. 6 in the nozzle base 201. The nozzle 212 then projects sound to the ear canal of the user through a sound port or opening in the end of the nozzle.

Figure 10A:
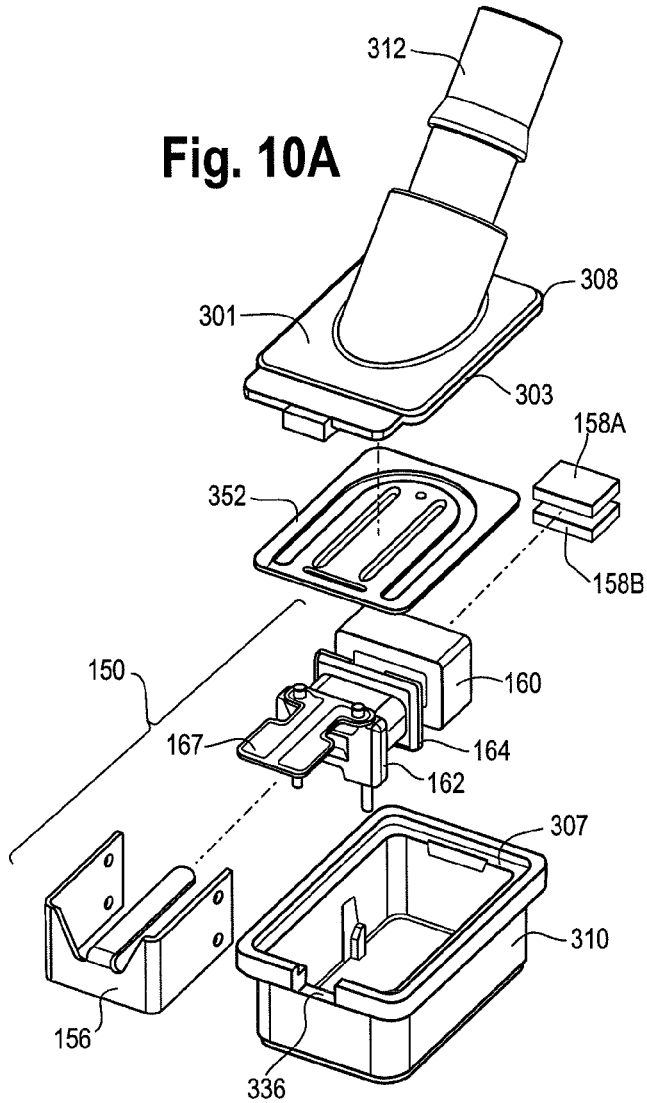
FIG. 10A depicts an exploded view of another embodiment of an earphone assembly.
Figure 10B:
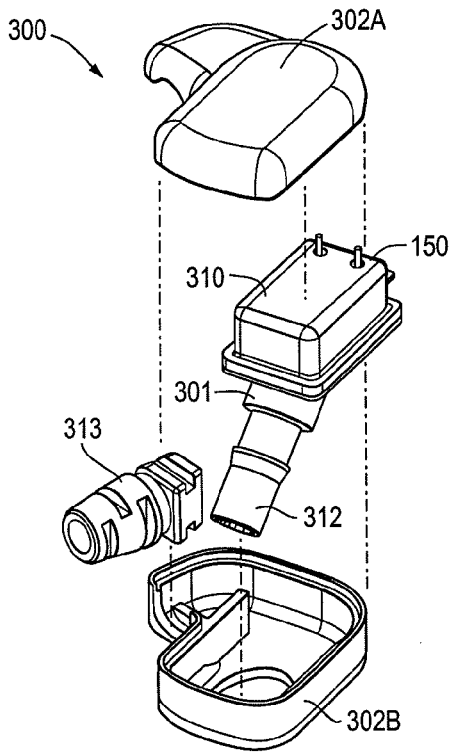
FIG. 10B depicts another exploded view of the embodiment shown in FIG. 10A with additional components.
Figure 10C:
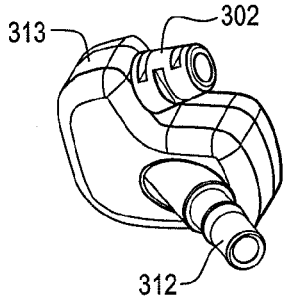
FIG. 10C depicts an assembled view of the embodiment shown in FIG. 10B.
Figure 11:
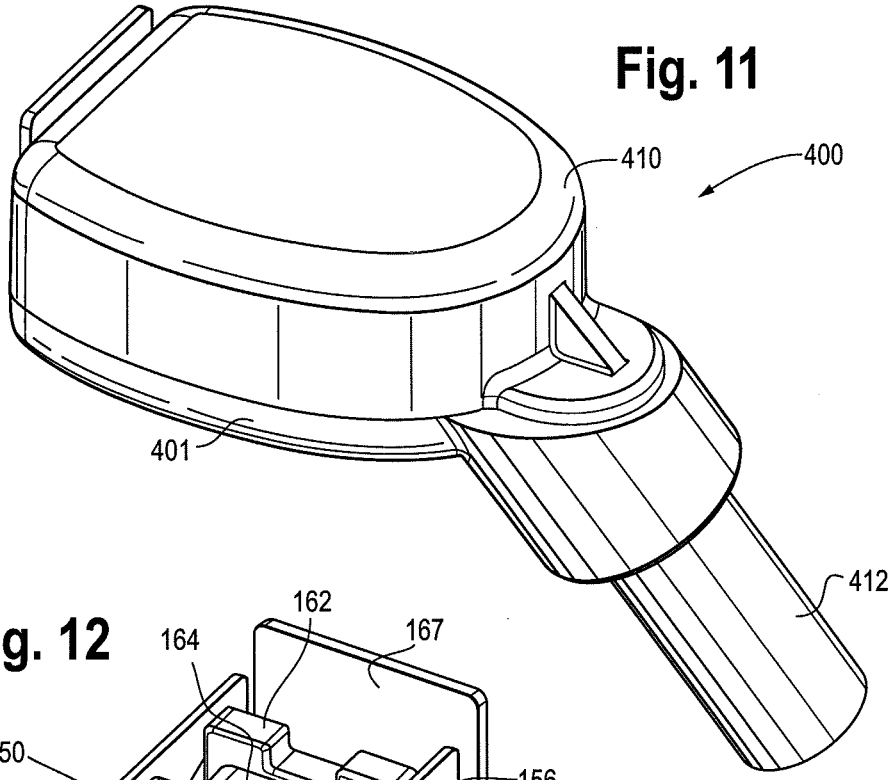
FIG. 11 depicts a front perspective view of another embodiment of an earphone assembly.

FIGS. 10A-10C depict another exemplary embodiment of a motor assembly 150 directly built into a box-shaped housing base 310 acting as a base part in the assembly 300. The assembly 300 includes a nozzle cover 301 with a nozzle 312 for outputting sound to a user's ear. The nozzle cover 301 is formed of a molded material and has a portion 303 adjacent to paddle 352. The paddle 352 and an outer rim portion 308 mounts in a correspondingly shaped recess 307 in the base 310. The base 310 and the outer rim portion 308 can be joined using any known fastening method. The base 310 can also be formed of a resilient material and can include a cutout 336 in the rear portion for receiving the flex board 167.

The nozzle cover 301 and the base 310 form an enclosure or an inner housing for a balanced armature driver motor assembly 150 having the components discussed above. The nozzle cover 301 and the base 310 can be formed of a molded material. As shown in FIGS. 10B and 10C, an outer cover 302A and a primary case portion 302B are assembled using any known fastening method to form an outer housing 302 enclosing the inner housing formed by the nozzle cover 301 and the base 310 to form an earphone assembly. A plastic sheath component 313 for a signal cable (not shown) can be mounted between the outer cover 302A and the primary case portion 302B. A sleeve (not shown) formed of foam, silicone, or other known suitable materials can be placed on the nozzle 312. The sleeve may be used to create a seal between the nozzle 312 and the listener's ear during use.

Figure 12:
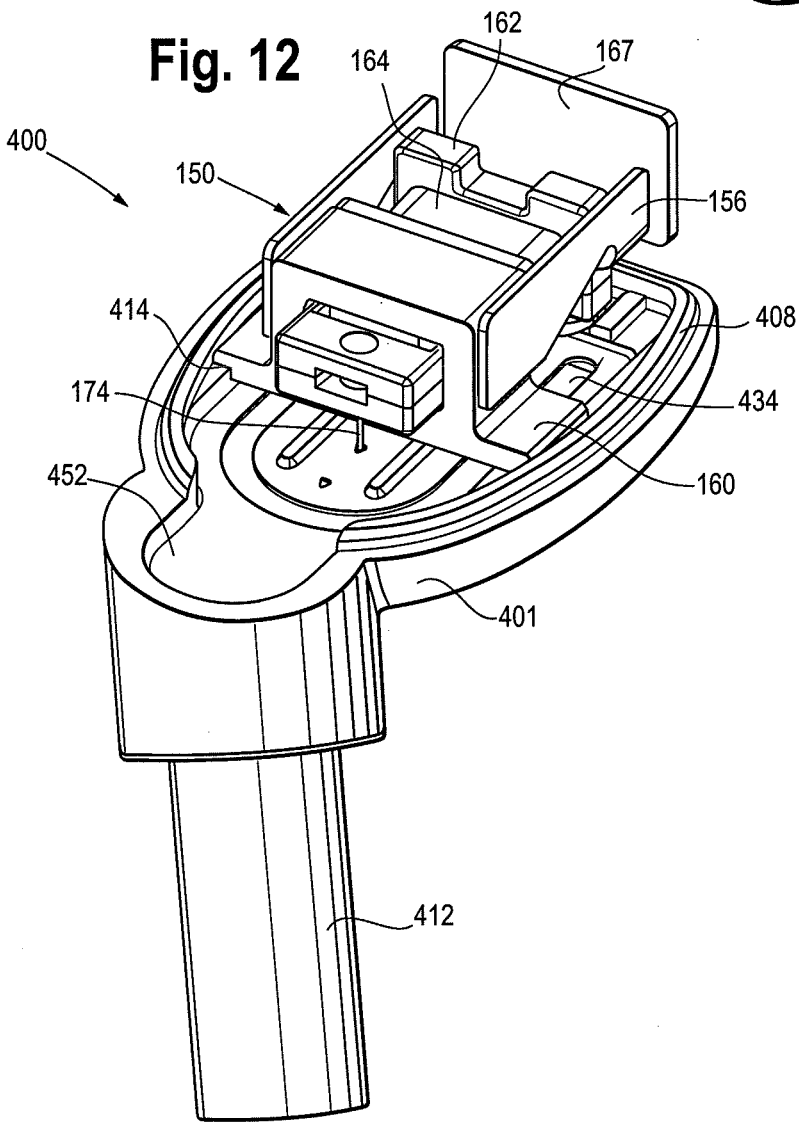
FIG. 12 depicts another front perspective view of the embodiment shown in FIG. 11.
Figure 13:
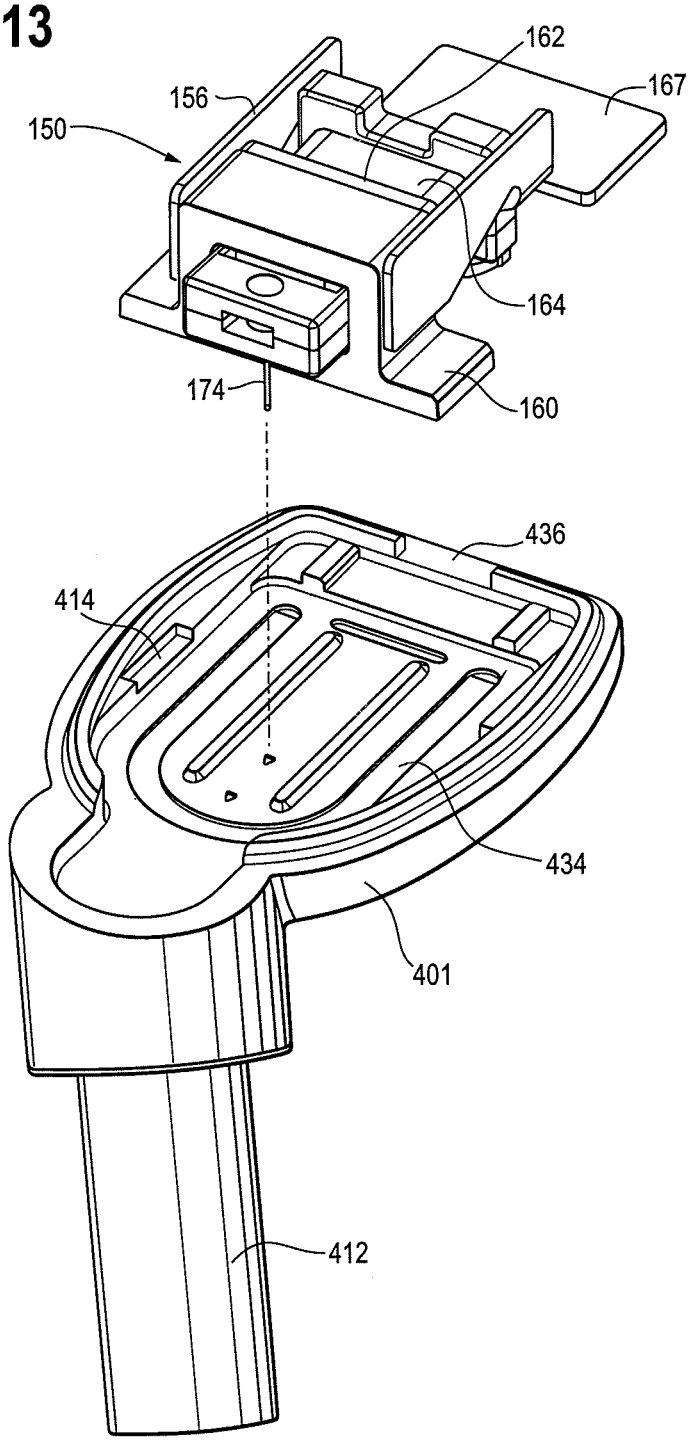
FIG. 13 depicts an exploded view of the embodiment shown in FIG. 12.
Figure 14:
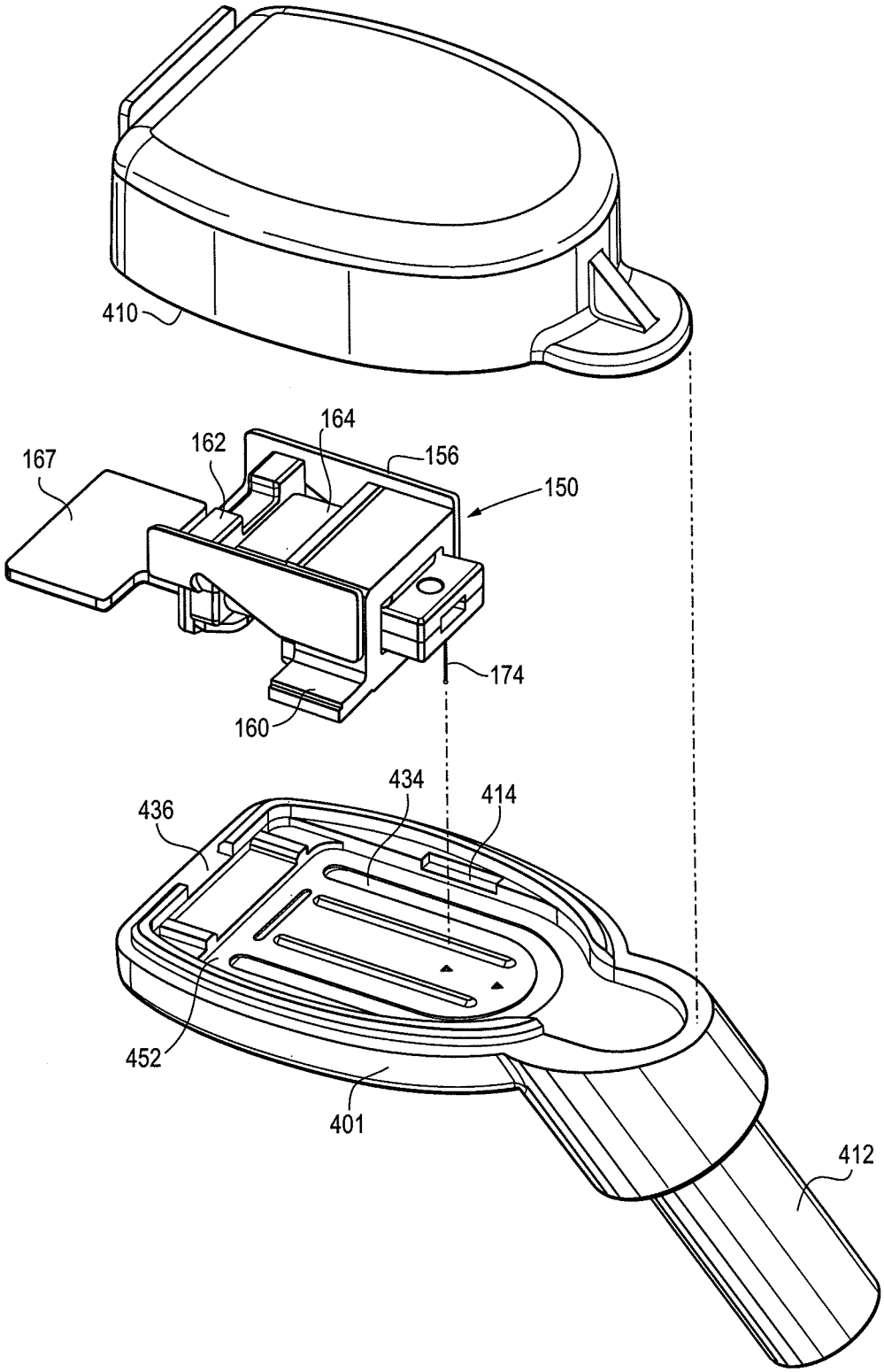
FIG. 14 depicts an exploded view of the embodiment shown in FIG. 11.
Figure 15:
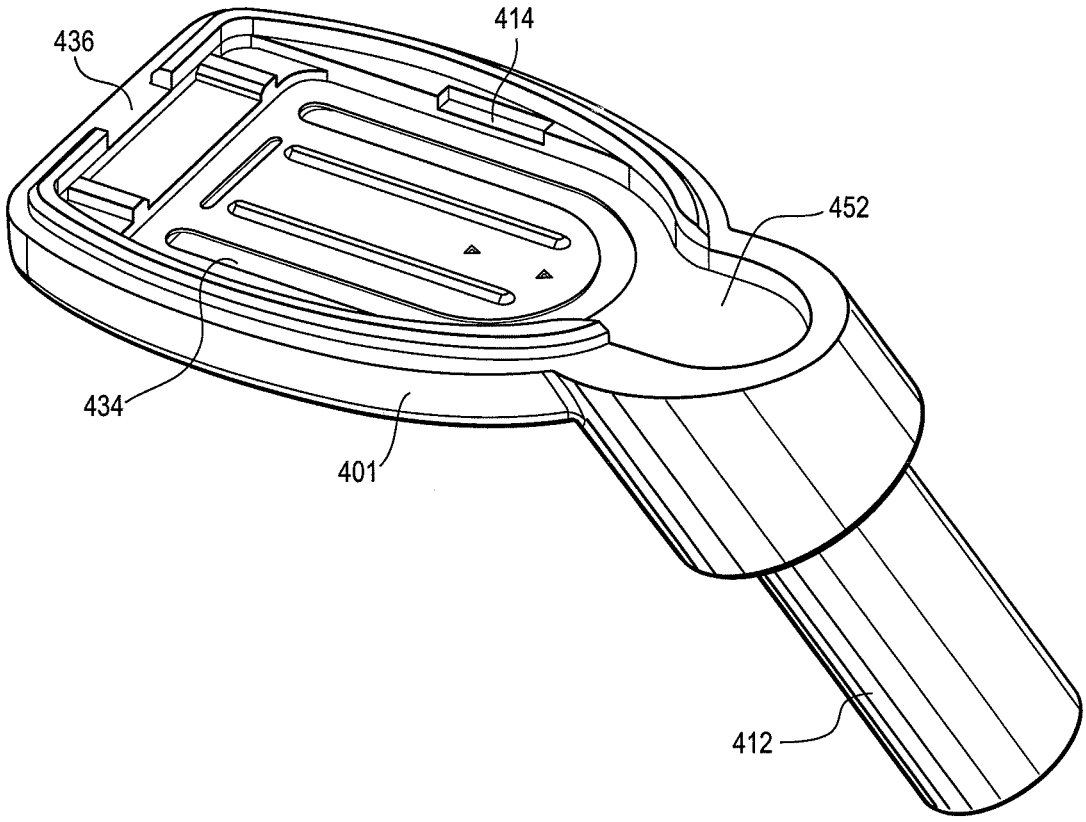
FIG. 15 depicts another perspective view of the embodiment shown in FIG. 11 without the motor assembly.

FIGS. 11-15 depict another exemplary embodiment of a balanced armature driver directly built into and integral with the nozzle assembly 400. The assembly 400 includes a nozzle base 401 with an integral nozzle 412, which can be formed of a molded material and configured to receive a sleeve, for placement into a user's ear canal to output sound to the user's ear. The nozzle base 401 provides locating, mating, and resting features for subsequent sub-assemblies such as the paddle 452 and motor assembly 150 that mate to the nozzle base 401. As shown in FIG. 12, the nozzle base 401 also has a recess 434 with mating features for receiving a paddle 452 and a notch portion 414 for locating and mounting the pole piece 160 of the motor assembly 150 to the nozzle base 401. A lip or rim 408 is configured to receive the cover 410. The lip 408 and the cover 410 can be secured using any known fastening method. The cover 410 and the nozzle base 401 form an inner housing which can be enclosed by an outer housing (not shown). As shown in FIG. 15, the nozzle base 401 is formed with a cutout or reservoir 434 for receiving the paddle 452. An additional cavity, (not shown, but similar to cavity 235 in FIG. 6) is formed under the paddle 452 and forms a portion of the front acoustic cavity in the transducer. The cover 410 forms a rear acoustic cavity in the transducer. The nozzle base 401 can also be provided with a cutout 436 in the rear portion for receiving the flex board 167.

Figure 16A:
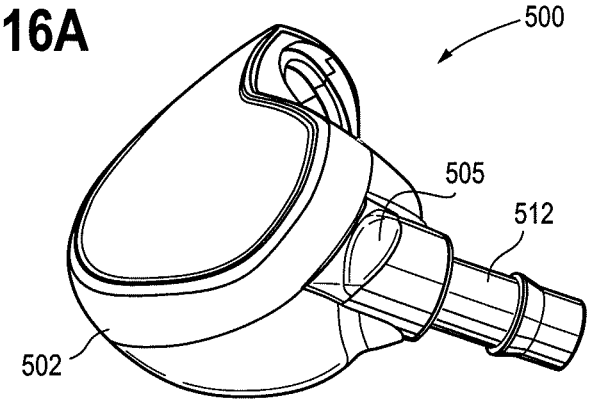
FIG. 16A depicts another exemplary embodiment of an earphone assembly.
Figure 16B:
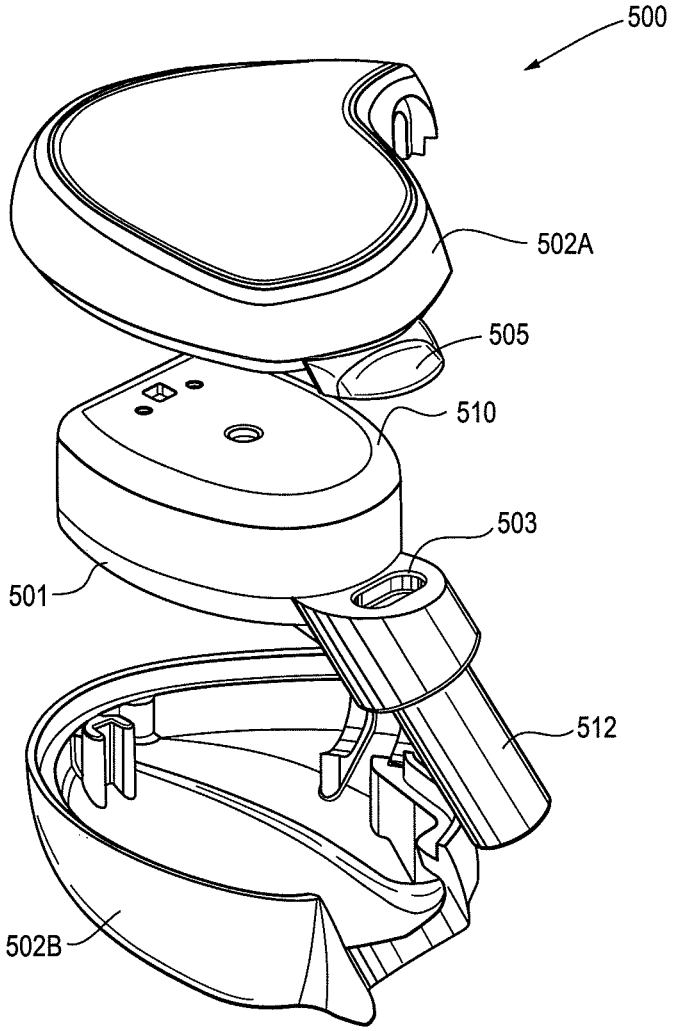
FIG. 16B depicts an exploded view of the exemplary embodiment of the earphone assembly shown in FIG. 16A.

FIGS. 16A and 16B depict a slight variation of the embodiment shown in FIGS. 11-15. The earphone assembly 500 has similar components to the embodiment shown in FIGS. 11-15 (with like reference numerals depicting like components as those described in such figures). The assembly 500 includes a nozzle base 501 with integral nozzle 512 for receiving a sleeve and outputting sound to a user. The nozzle base 501 and a cover 510 form an enclosure or an inner housing for a motor assembly and can be secured using any known fastening method. The nozzle base 501 and the cover 510 can also be formed of a molded material. The nozzle base 501 additionally includes a recess 503 for receiving a projection 505 in an outer cover 502A for alignment and assembly purposes. The outer cover 502A and a primary case portion 502B mate to form an outer housing 502 enclosing the inner housing formed by the nozzle base 501 and the cover 510 to form an earphone assembly. The outer cover 502A and a primary case portion 502B can be joined together with the nozzle base 501 and cover 510 using any known fastening method.

A front acoustic cavity consisting of a recess volume in the nozzle base that is under the paddle coupled directly to a geometric volume consisting of the internal features within the integral nozzle all within the same part has the benefit of a consistent geometric shape and frequency response resulting from the acoustic cavity. This also aids in reducing acoustic leaking and reducing the number of components for providing the acoustic seal resulting in a simplified design.

FIGS. 17-25 depict an alternative embodiment earphone assembly 600. The assembly comprises an outer cover 602A and a primary case portion 602B, which when joined together by any known fastening method form an outer housing 602 for the earphone assembly 600. Within the outer housing 602 is an inner housing 604 containing a balanced armature motor assembly 150 similar to the motor assemblies described in reference to the other embodiments herein (with like reference numerals referring to like components thereof). The inner housing 604 is formed of an inner cover portion 604A and a spout base portion 604B. During assembly, the inner cover portion 604A and the spout base portion 604B are sealed together using any known fastening method. The inner housing 604 encloses the motor assembly 150.

The spout base portion 604B includes a spout 620 having a recessed portion 622 for receiving an o-ring 624. As shown best in FIG. 21, the spout base portion 604B also includes an internal recess 626 for locating and receiving a paddle 652. Additionally, the spout base portion 604B also has a notch portion 614 for locating and mounting the pole piece 160 of the motor assembly 150 to the nozzle base 604B. During assembly, the paddle 152 is acoustically sealed to the spout base portion 604B.

Figure 17:
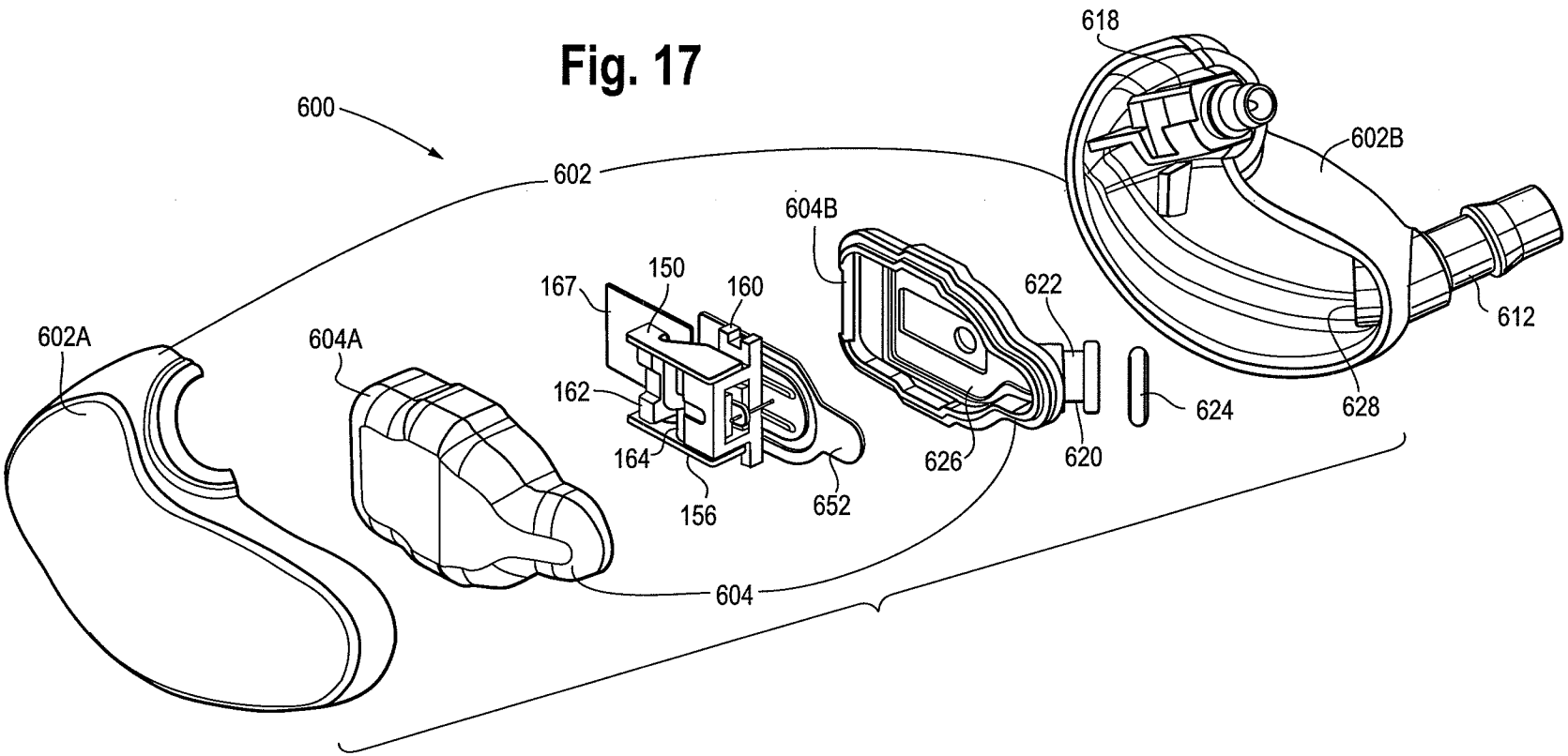
FIG. 17 depicts an exploded view of another embodiment of an earphone assembly.
Figure 18A:
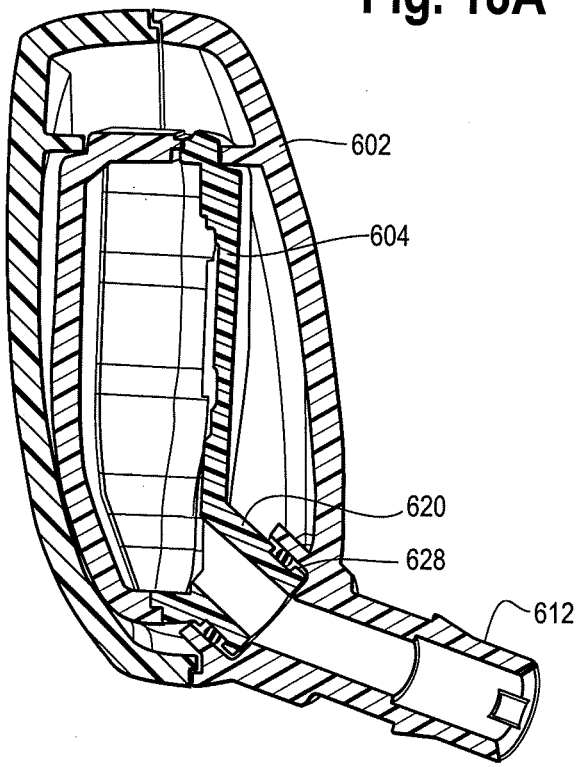
FIG. 18A depicts a cross-sectional view of the embodiment shown in FIG. 17.
Figure 18B:
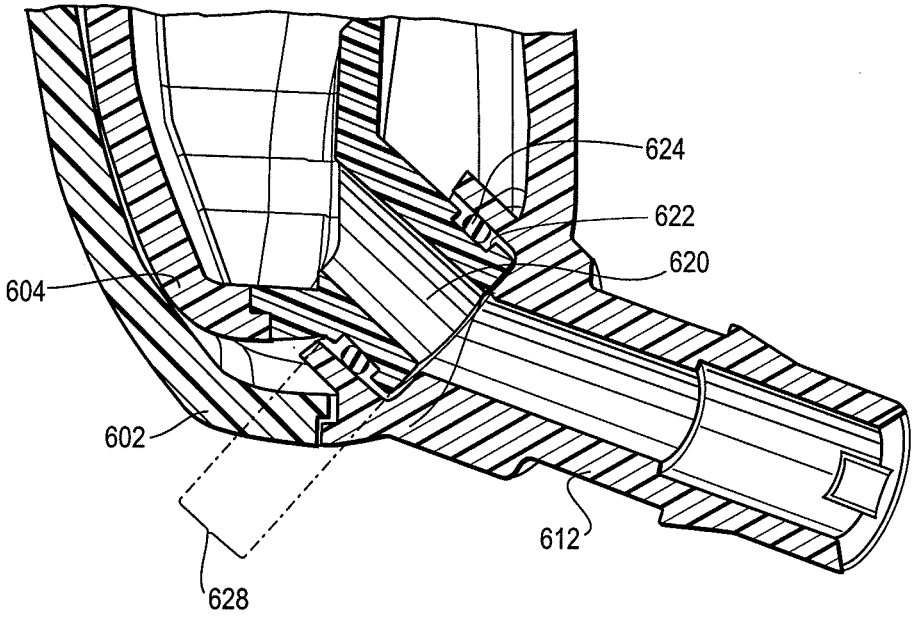
FIG. 18B depicts a magnified view of a portion of FIG. 18A.
Figure 19:
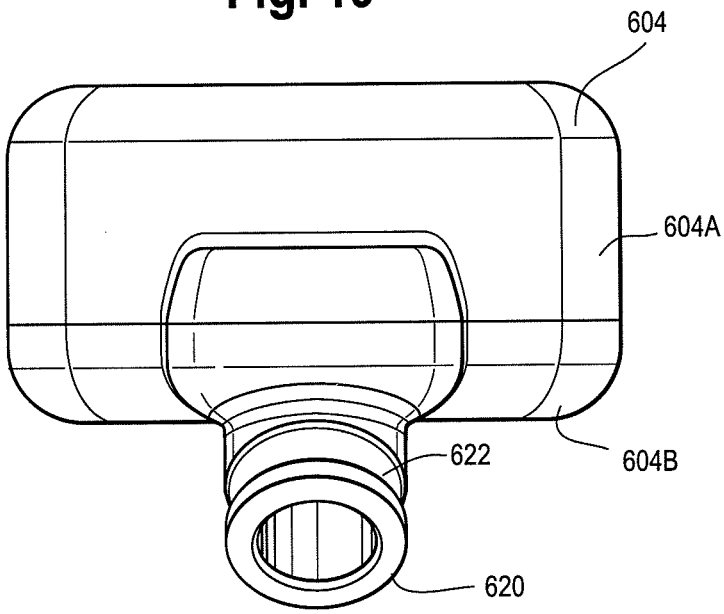
FIG. 19 depicts a perspective front view of a portion of the embodiment shown in FIG. 17.
Figure 20:
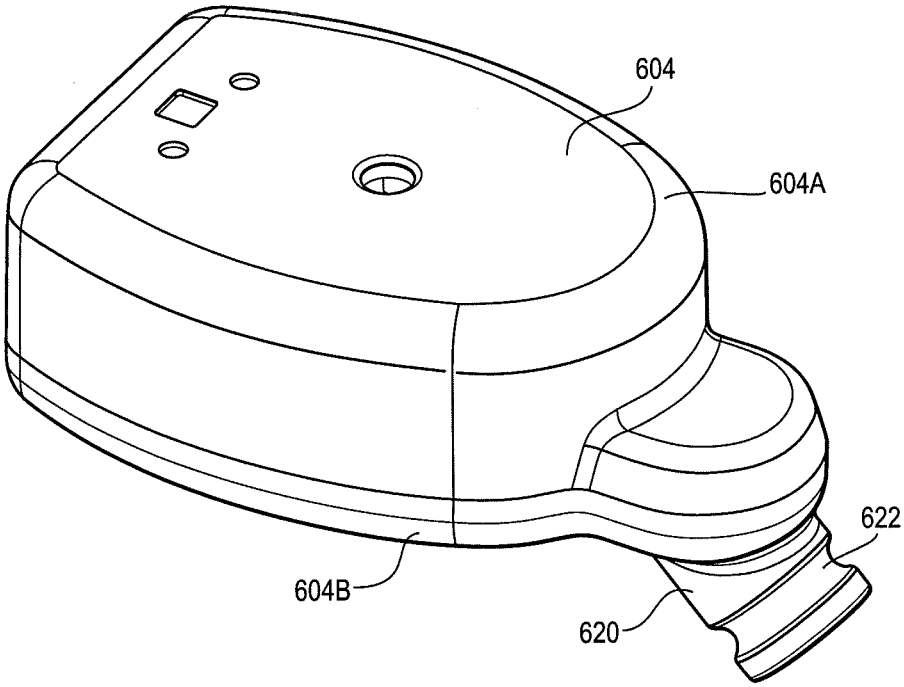
FIG. 20 shows a perspective front side view of the portion shown in FIG. 19.
Figure 21:
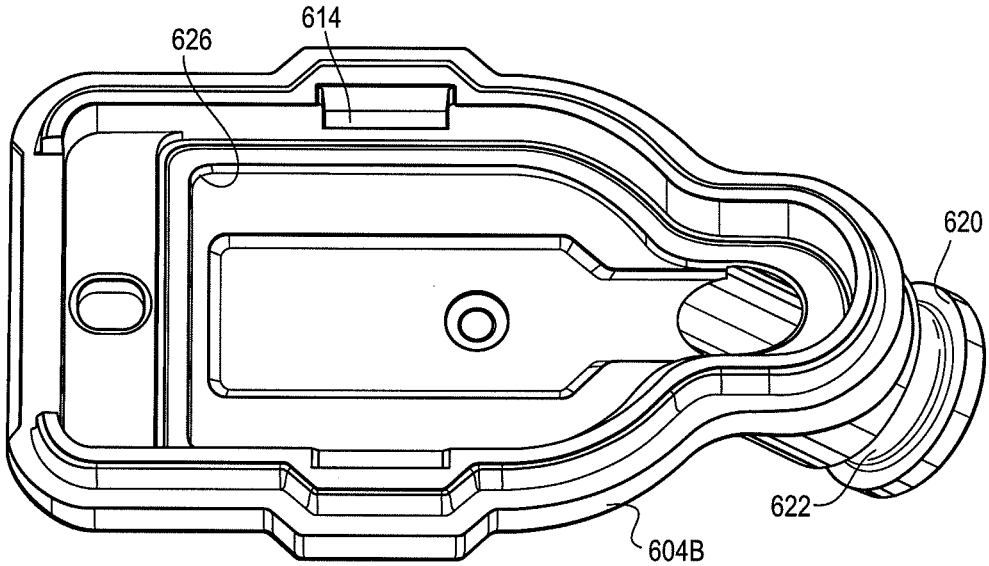
FIG. 21 shows a perspective view of a portion of the assembly shown in FIG. 17.
Figure 22:
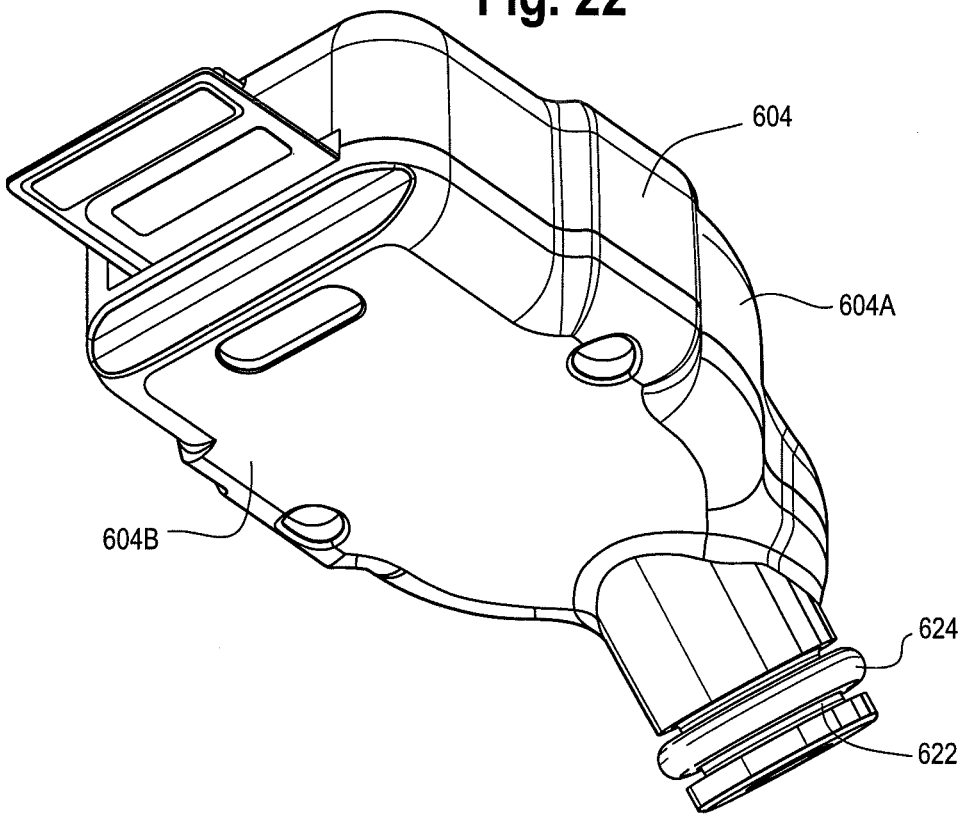
FIG. 22 shows a rear bottom perspective view of a portion of the embodiment shown in FIG. 17.
Figure 23:
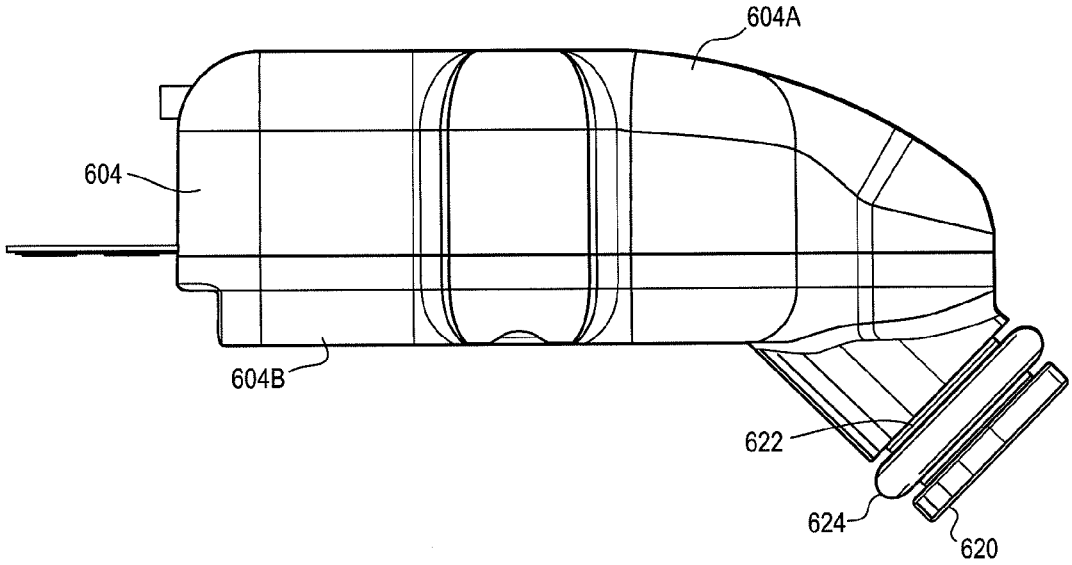
FIG. 23 shows a side perspective view of a portion of the embodiment shown in FIG. 17.
Figure 24:
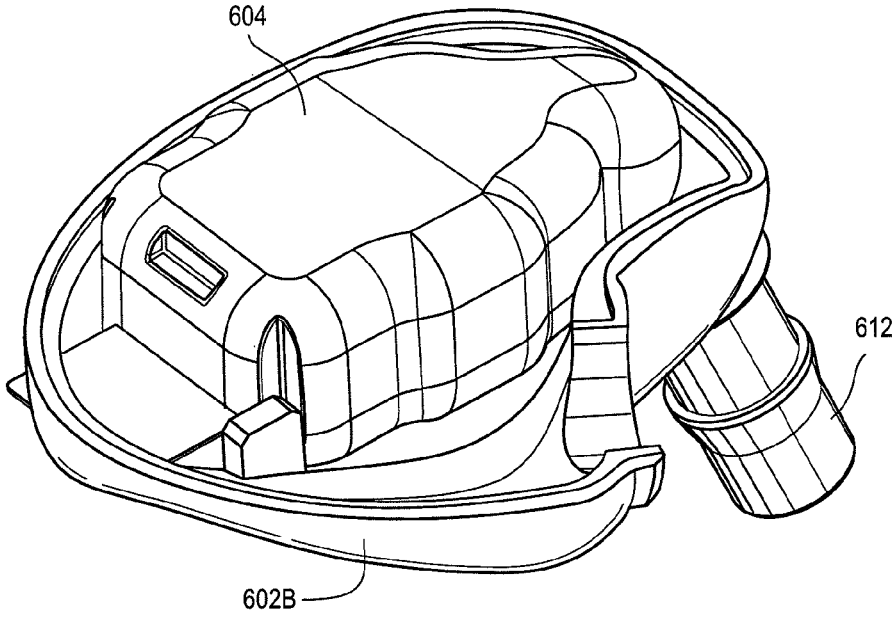
FIG. 24 shows a rear perspective view of a portion of the embodiment shown in FIG. 17.
Figure 25:
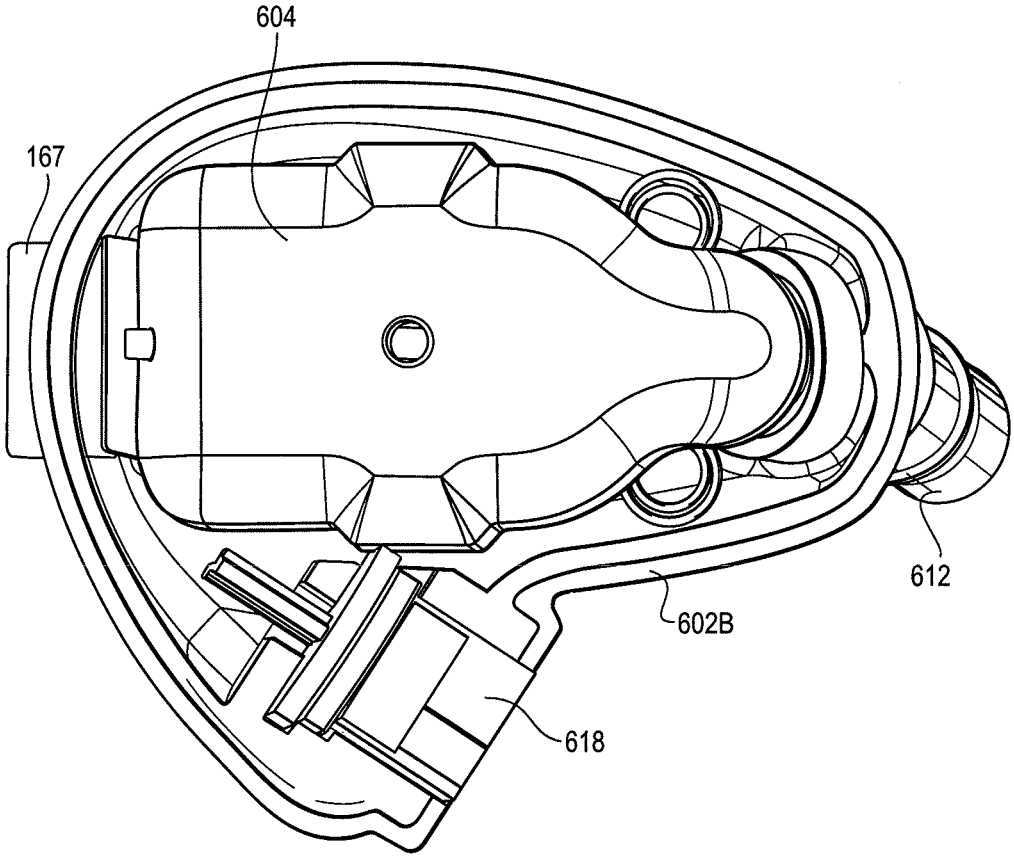
FIG. 25 shows a top perspective view of a portion of the embodiment shown in FIG. 17

The primary case portion 602B also includes an integral nozzle 612. The interior portion of the nozzle 612 includes an internal recess 628 or a counterbore shaped collector for receiving the spout 620 and o-ring 624. A cross section of both the outer housing 602 and the inner housing 604 when coupled is depicted in FIGS. 18A and 18B. As shown in FIGS. 18A and 18B, the spout together with the o-ring 624 creates an acoustical seal within the recess 628 of the outer housing 602. When the o-ring 624 is placed into contact with the recess 628 in the outer housing 602, radial forces act on the spout 620 to maintain the acoustical seal between the spout 620 and the outer housing 602. Optionally, the outer housing 602 can be configured to additionally impart axial forces on the inner housing 604 so as to cause the spout 620 to maintain its acoustic seal with the nozzle 612. The spout 620 and the nozzle 612 form a continuous sound passage to a user's ear canal. As shown in FIG. 17, the primary case portion 602B also includes a coupling 618 for receiving a signal cable (not shown).

The nozzle 612 mates with a sleeve (not shown) placed over the end of the nozzle 612, which is inserted into a user's ear. When the motor assembly 150 receives a signal, it in turn creates sound and outputs the sound into the spout 620. Because the spout is placed in the recess 628 within the nozzle 612, the sound travels directly from the spout into the nozzle 612, which projects the sound into a user's ear canal.

The pole piece 160 and the bobbin 162 and coil 164 act as a locating and support mechanism for assembling the motor assembly 150 to the spout base portion 604B. The pole piece 160 in conjunction with a center post in the bobbin act as a support bracket, which functions as a mounting and support mechanism for the entire motor assembly 150 to mate locating features in the spout base portion 604B.

Unlike other embodiments which require left and right specific housings and configurations, the spout o-ring configuration provides a symmetrical "non-handed" design and provides for a higher quality and accuracy in manufacturing. More specifically, while the outer housing 602 must be specifically manufactured to be either a left ear housing or a right ear housing, the inner housing 604 may be configured to be universal, and capable of being mounted inside either a "left handed" outer housing 602 or a "right handed" outer housing 602. This design can also reduce the overall stress on the motor assembly by reducing the amount of internal forces placed in the motor housing and leads to improved shock absorption. It also allows for a more compact driver design. The design is also platformable and can be used in other earphone designs and devices.

Figure 1A:
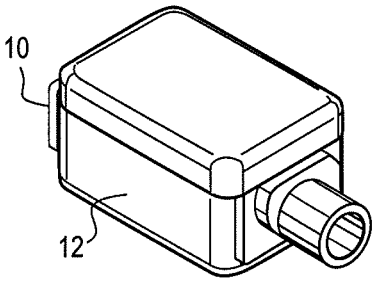
Fig. 1A PRIOR ART
FIG. 1A depicts a perspective view of a prior art balanced armature driver assembly.
Figure 1B:
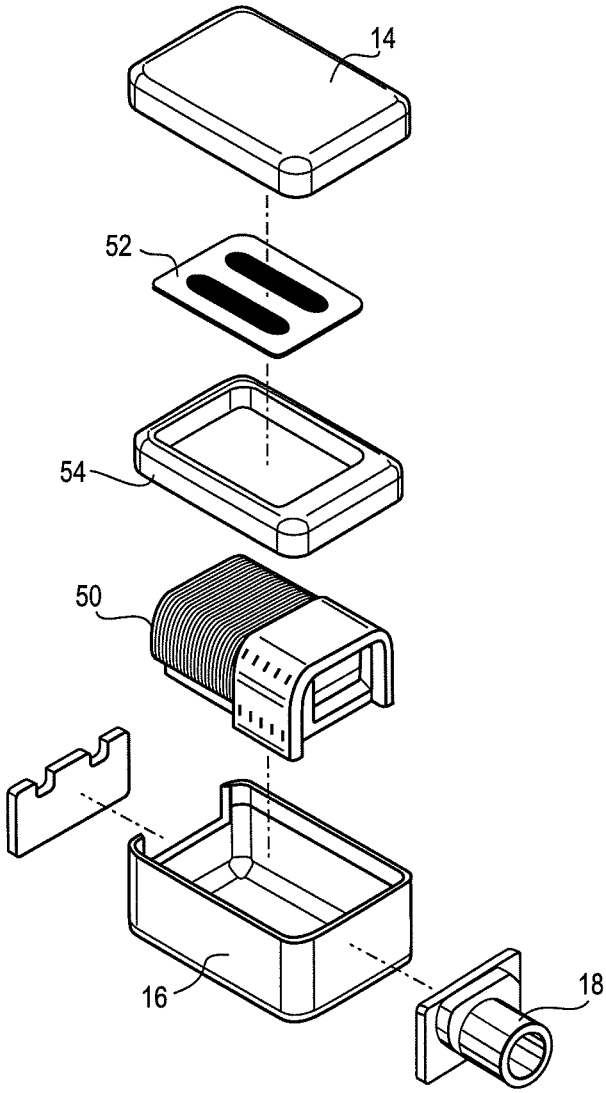
Fig. 1B PRIOR ART
FIG. 1B depicts an exploded view of the prior art balanced armature driver assembly of FIG. 1A.
Figure 2:
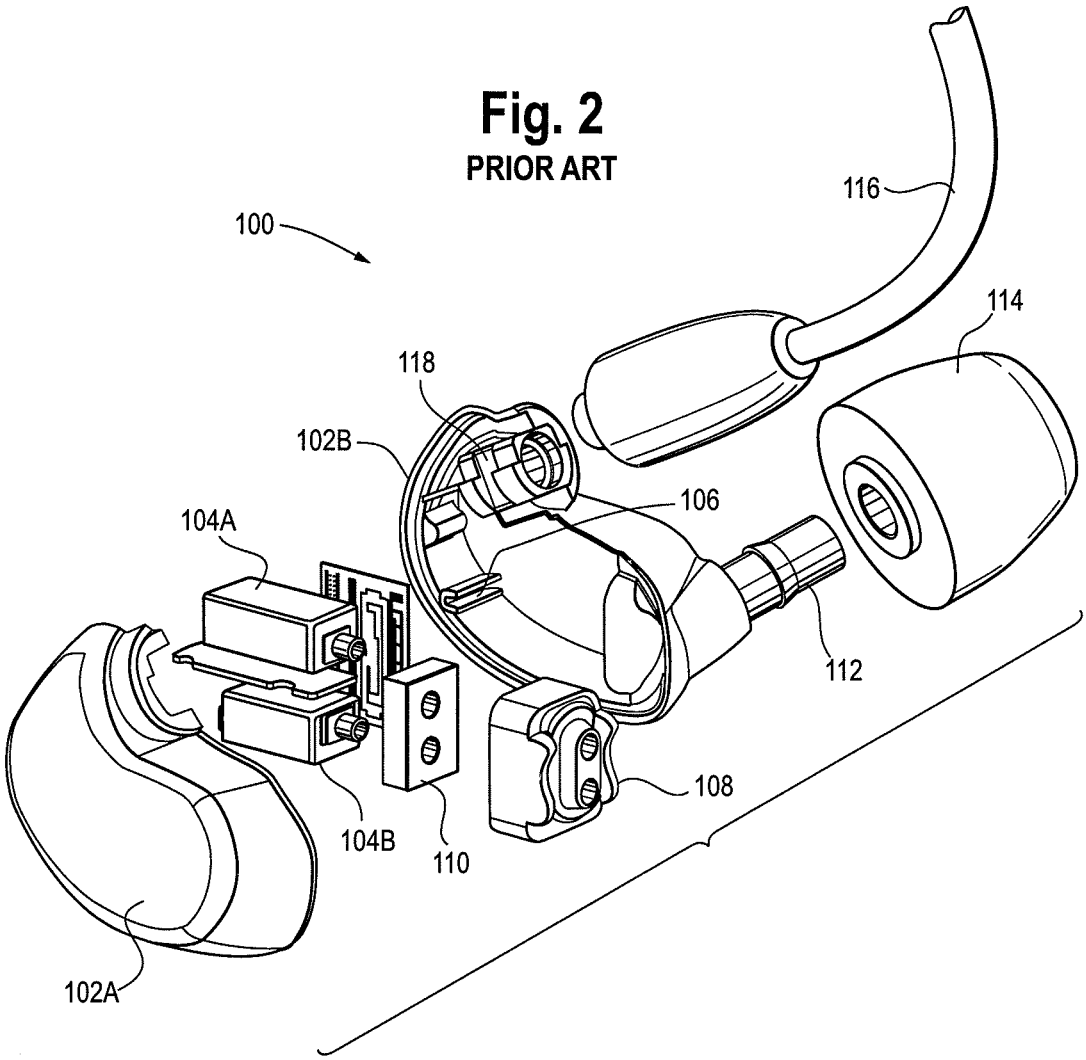
Fig. 2 PRIOR ART
FIG. 2 depicts an exploded view of a prior art earphone assembly.

The spout o-ring sealing method maintains a complete seal without any preloads necessary on the driver. As shown in prior art FIG. 1, the drivers are preloaded against the ribs 106 of the outer housing 102 to provide the acoustic seal. In particular, the ribs 106 provide a compressive force on the armatures 104A, 104B so as maintain the acoustic seal by pressing the armatures 104A, 104B up against the Poron seal 110, the TPE seal 108, and the nozzle 112. Although this method is effective in providing an acoustical seal in the earphone and could be used in conjunction with the methods and approaches disclosed herein, in these designs maintaining an the acoustic seal without leaking between the mating earphone shells may be more difficult because they require a more complex means to create the seal (i.e. force applied in the axial direction). In the spout o-ring configuration, ribs on the outer housing may not be needed to maintain the armature acoustically sealed with the nozzle.

Secondly, the amount of 'real estate' this approach needs is decreased in that the small o-ring and mating counter bore shaped collector can take up less size in the overall assembly.

The spout o-ring design also optimizes the part break up of the overall earphone transducer design. Because of the way the design breaks up into sub-assemblies and parts, it maximizes open processing surfaces, minimizes the number of necessary parts, minimizes tolerance stack up, and undesirable part interactions. This improves product quality by optimizing the parts locating and fitting together within the transducer in a robust fashion during assembly in a manufacturing and reduces the likelihood of acoustic leaking between the front and rear acoustic cavities within the transducer. Having a base part with locating features also enables Z-axis "pick and place" automation of sub-assemblies that mate to the spouted base portion in manufacturing. For example, during manufacturing, the nozzle bases can be placed into a holding carrier that moves through an assembly line where additional sub-assemblies such as the paddle, motor assembly, and cover parts can be picked and placed with robot vacuum arms. Z-axis "pick and place" means that gravity works to have the parts fall into their seated position without the need for additional hold down mechanisms.

Additionally, mating sub-assemblies can be added to the spout base portion without taking the base portion out of a holding fixture during transducer assembly in a manufacturing environment, resulting in less handling and reorientation of the work parts during manufacturing.

The design also simplifies the mating interface between the spout base portion to the primary case portion by using an o-ring concentric sealing interface consisting of a recess or groove in a spout and a counterbore shaped collector. Additionally, the spout is not "handed" thus enabling the transducer assembly to be used in both a left earphone and a right earphone.

Figure 26:
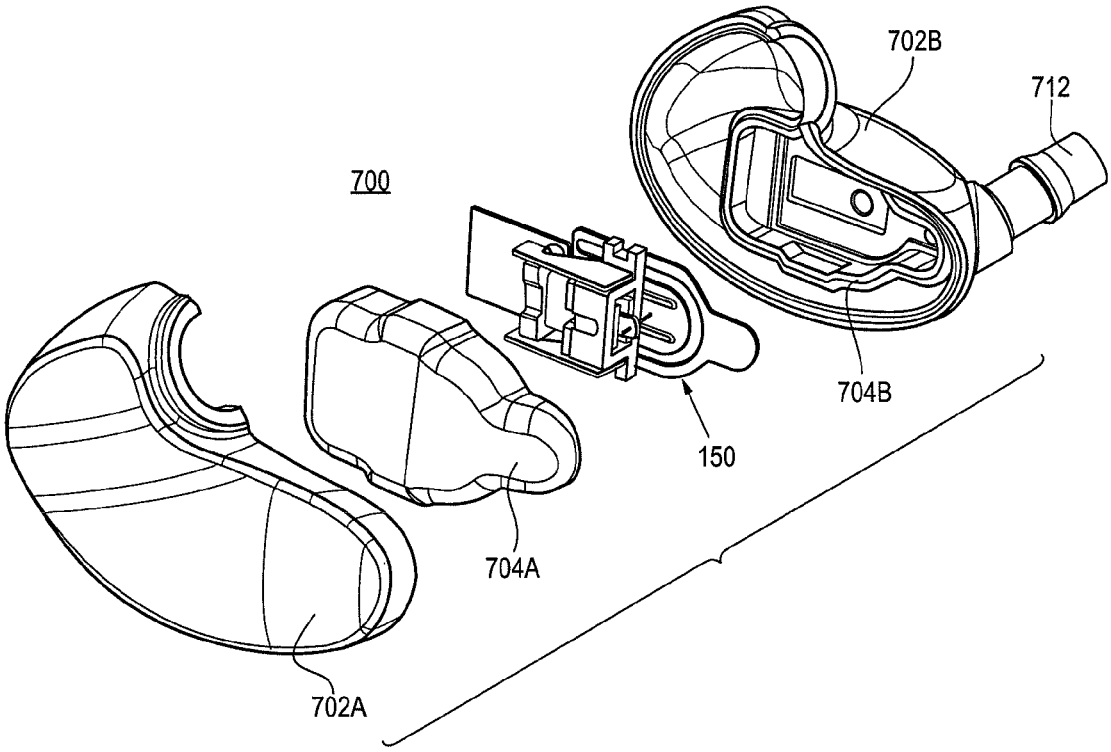
FIG. 26 depicts an exploded view of another embodiment of an earphone assembly.

FIG. 26 depicts an alternative embodiment earphone assembly 700. The assembly 700 is similar to the assembly 600 shown in FIGS. 17-25, however, instead of having a spout base portion 604B, a base portion 704B is formed integral with the primary case portion 702B having a nozzle 712. The inner housing is formed of an inner cover portion 704A and a base portion 704B and contains the balanced armature driver motor assembly 150. During assembly, the inner cover portion 704A and the base portion 704B are sealed together using any known fastening method and the outer cover 702A encloses the inner housing formed by the inner cover portion 704A and the base portion 704B.

Figure 27A:
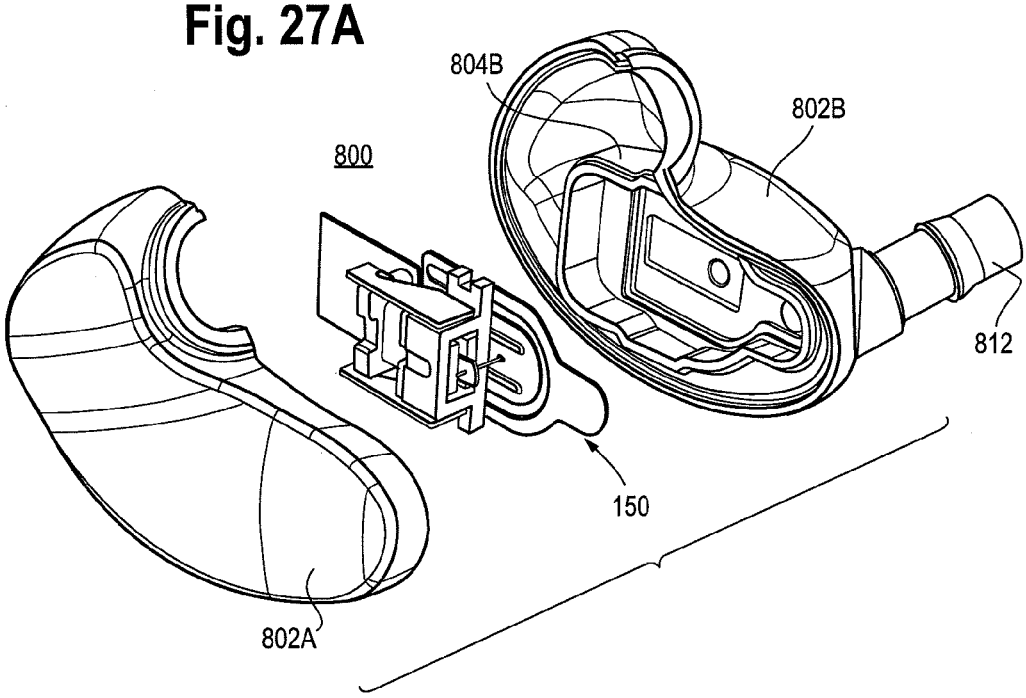
FIGS. 27A and 27B depict exploded views of another embodiment of an earphone assembly.
Figure 27B:
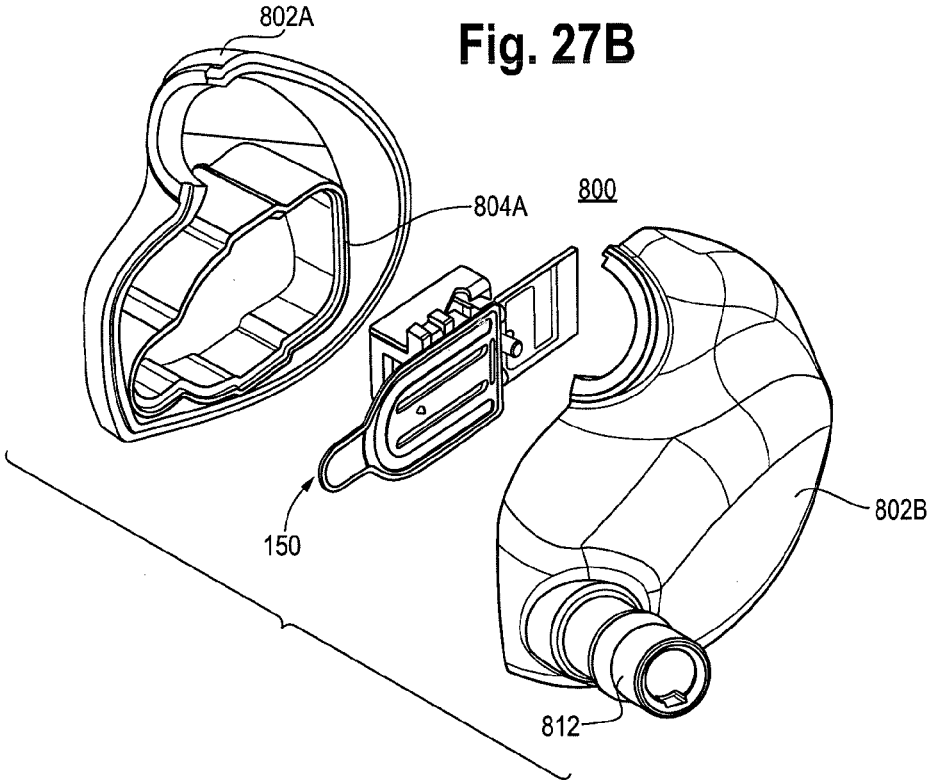

FIGS. 27A and 27B depict an alternative embodiment earphone assembly 800. The assembly 800 is similar to the assembly 600 shown in FIGS. 17-25, however, instead of having a spout base portion 604B, a base portion 804B is formed integral with the primary case portion 802B having a nozzle 812. Furthermore, instead of having an inner cover portion 604A separate from an outer cover 602A, an inner cover portion 804A is formed integral with an outer cover 802A. During assembly, the motor assembly 150 is mounted in the inner cover portion 804A. The inner cover portion 804A, the base portion 804B are sealed together along with the outer cover portion 802A and the primary case portion 802B using any known fastening method to form the assembly 800.

Figure 28:
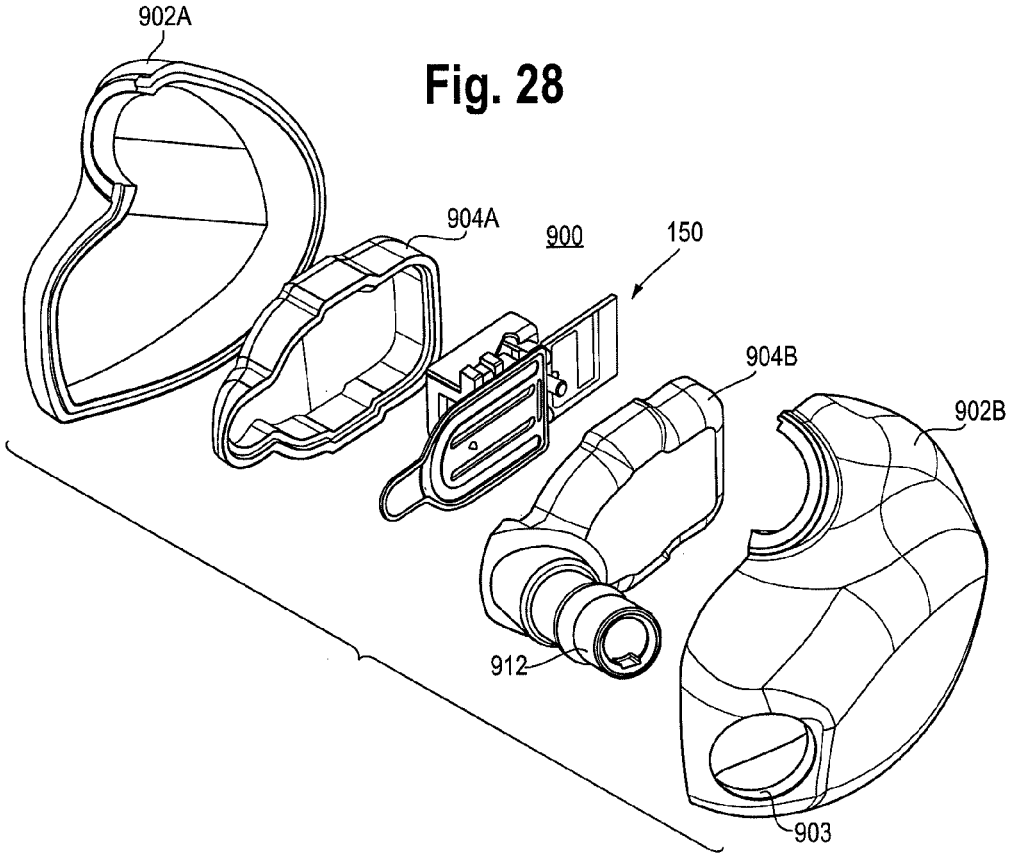
FIG. 28 depicts an exploded view of another embodiment of an earphone assembly.

FIG. 28 depicts an alternative embodiment earphone assembly 900. The assembly 900 is similar to the assembly 600 shown in FIGS. 17-25, however, instead of having a spout base portion 604B, a base portion 904B is formed with an integral nozzle 912 that extends through a hole 903 in a primary case portion 902B. Thus, the nozzle 912 is part of the base portion 904B rather than the primary case portion 902B. The balanced armature driver motor 150 is secured to the base portion 904B and an inner cover portion 904A is secured to the base portion 904B using any known fastening method. The base portion 904B can then be secured to the primary case portion 902B such that the nozzle 912 extends through hole 903. The outer cover 902A can be secured to the primary case portion 902B.

Figure 29:
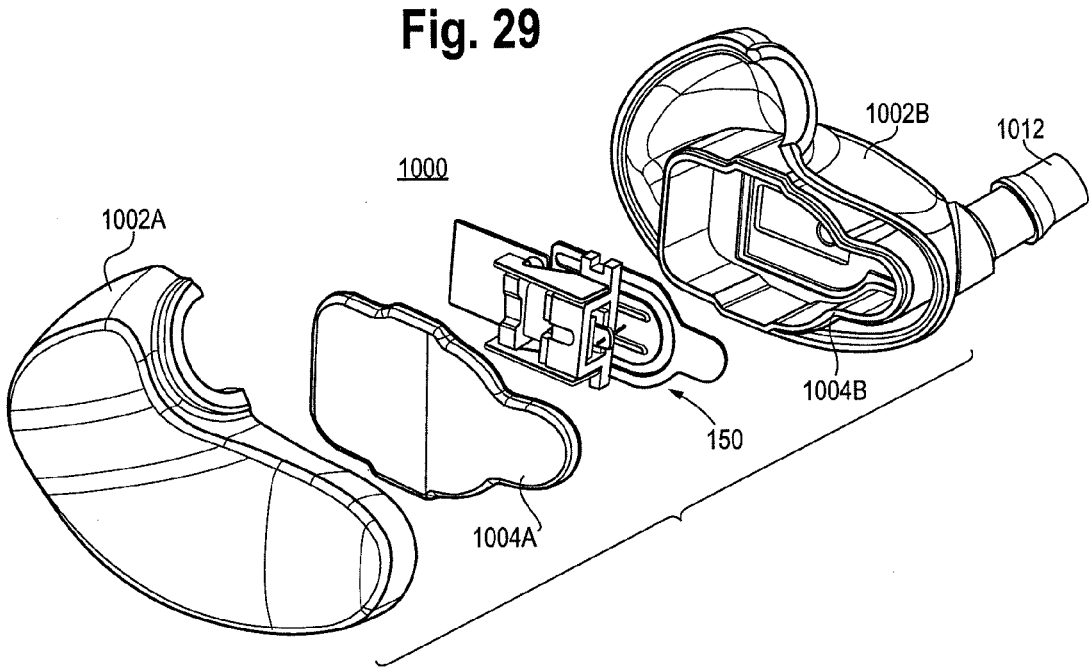
FIG. 29 depicts an exploded view of another embodiment of an earphone assembly.

FIG. 29 depicts an alternative embodiment earphone assembly 1000. The assembly 1000 is similar to the assembly 600 shown in FIGS. 17-25, however, instead of having a spout base portion 604B, a base portion 1004B is formed integral with the primary case portion 1002B having a nozzle 1012. Additionally, the inner housing is formed of an inner lid portion 1004A and the base portion 1004B, which contains the balanced armature driver motor assembly 150. In an embodiment, the inner lid portion 1004 is relatively flat. During assembly, the inner lid portion 1004A and the base portion 1004B are sealed together using any known fastening method, and the outer cover 1002A encloses the inner housing formed by the inner lid portion 1004A and the base portion 1004B.

Figure 30:
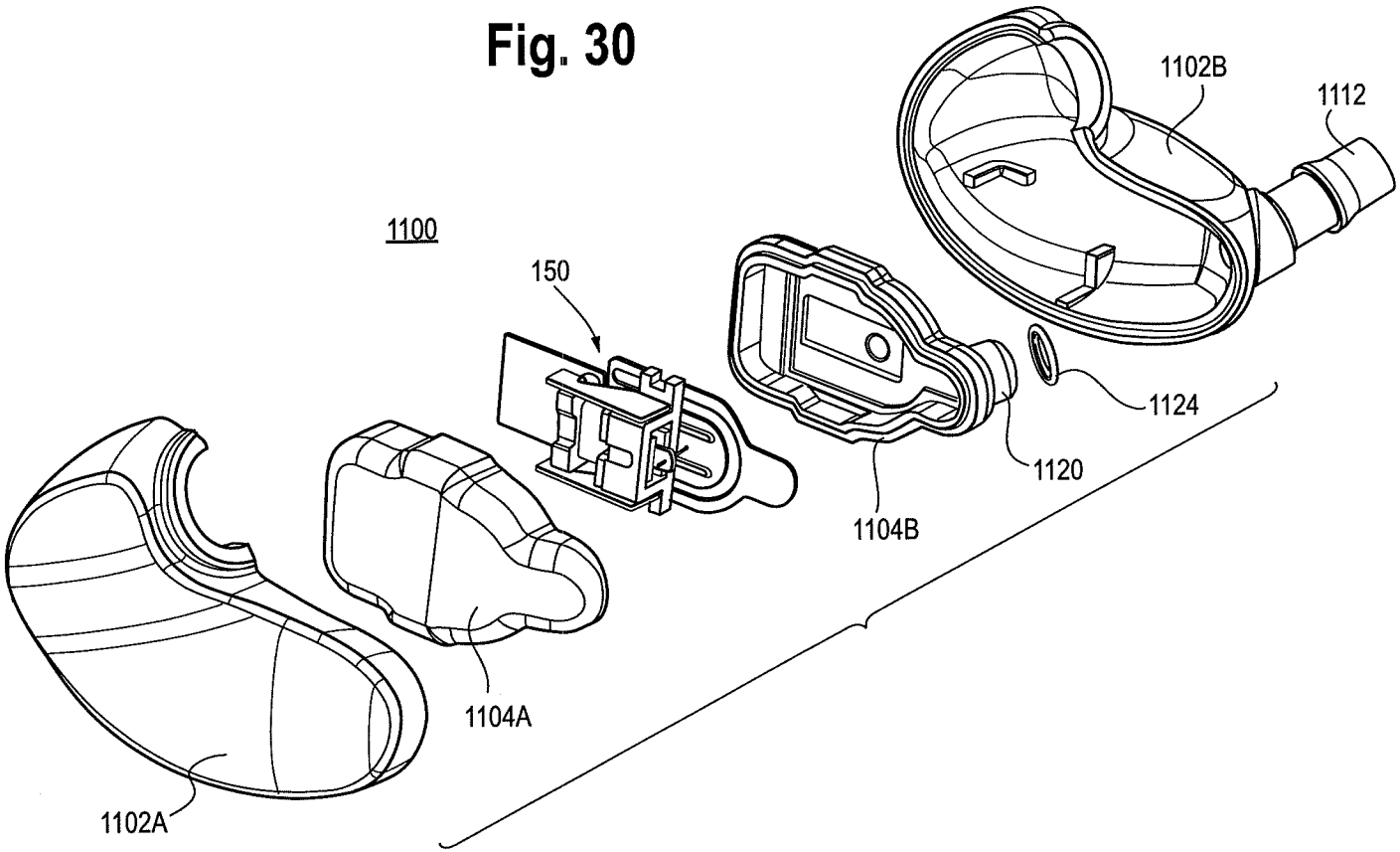
FIG. 30 depicts an exploded view of another embodiment of an earphone assembly.
Figure 31A:
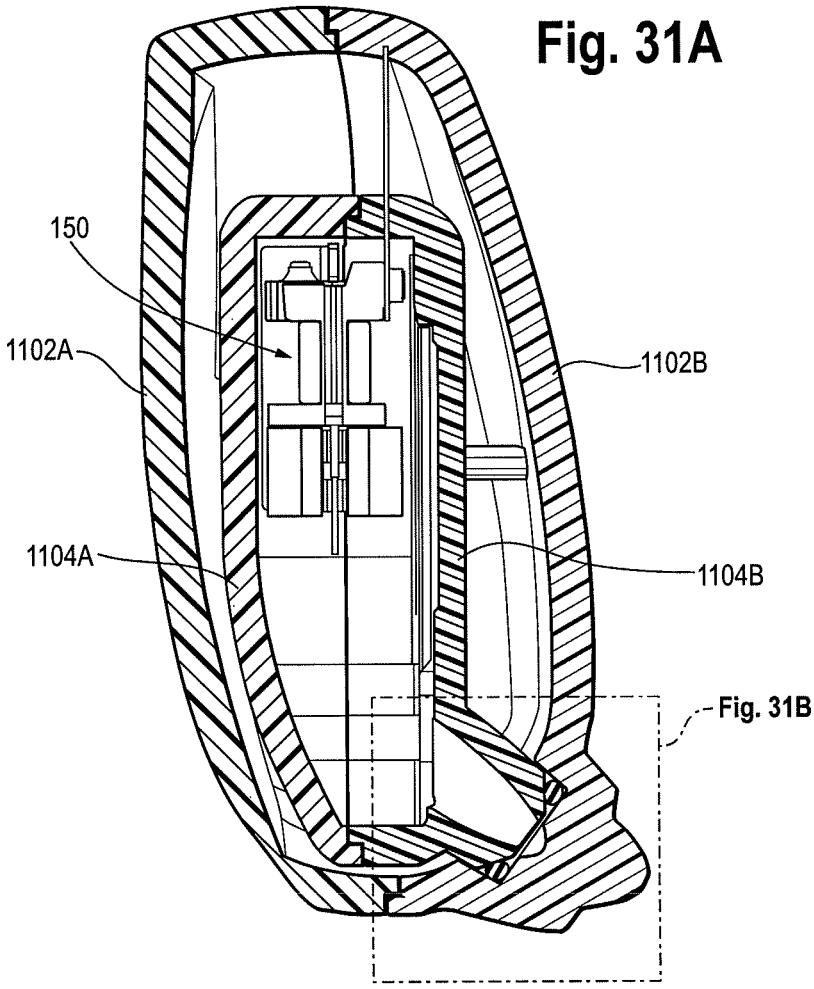
FIG. 31A depicts an assembled view of the embodiment depicted in FIG. 30.
Figure 31B:
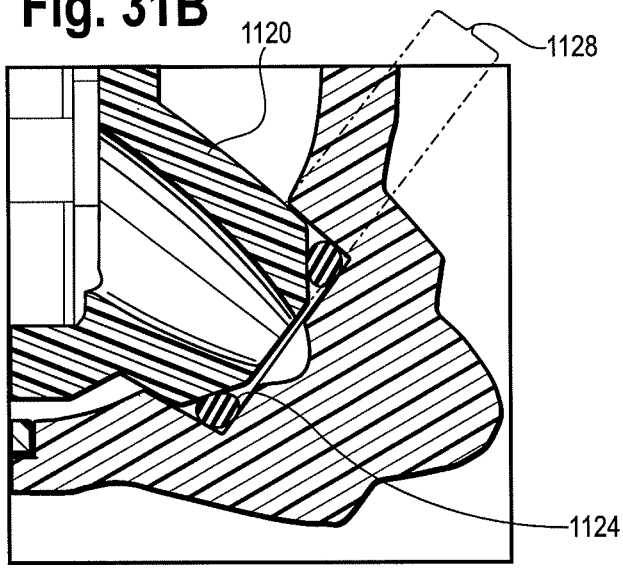
FIG. 31B depicts a magnified view of a portion of the embodiment shown in FIG. 31A.

FIGS. 30-31B depict an alternative embodiment earphone assembly 1100. The assembly 1100 is similar to the assembly 600 shown in FIGS. 17-25, however, the spout 1120 does not include a recessed portion for receiving the o-ring 1124 to create a radial force on the spout 1120. Rather as shown in FIG. 31B, the o-ring 1124 is sandwiched between an outer tapered rim portion of the spout 1120 and a top portion of the primary case portion 1102B near recess 1128. The assembly comprises an outer cover 1102A and a primary case portion 1102B having a nozzle 1112 configured to receive a sleeve. The primary case portion 1102B and the outer cover 1102A are joined together by any known fastening method to form an outer housing for the earphone assembly 1100. The inner housing is formed of an inner cover portion 1104A and a spout base portion 1104B and is placed within the outer housing and contains a balanced armature motor assembly 150 similar to the motor assemblies described in reference to the other embodiments herein. During assembly, the inner cover portion 1104A and the spout base portion 1104B are sealed together using any known fastening method, and the inner housing encloses the motor assembly 150. The spout 1120 on spout base portion 1104B is then placed into contact with the o-ring 1124 which is sandwiched into recess 1128 to create an axial force on the inner housing such that an acoustic seal is formed between the inner housing components (inner cover portion 1104A, spout base portion 1104B) and the outer housing components (outer cover 1102A, primary case portion 1102B) and the inner housing is maintained in position.

Aspects of the invention have been described in terms of illustrative embodiments thereof. Numerous other embodiments, modifications and variations within the scope and spirit of the disclosed invention will occur to persons of ordinary skill in the art from a review of this entire disclosure. For example, one of ordinary skill in the art will appreciate that the steps illustrated in the illustrative figures may be performed in other than the recited order, and that one or more steps illustrated may be optional in accordance with aspects of the disclosure.

What is claimed is:

1. An earphone assembly comprising:

an inner housing containing a balanced armature motor assembly, the inner housing comprising an inner cover portion and a base portion, the base portion comprising a spout with a sound outlet;

an outer housing comprising a nozzle for transmitting sound, the outer housing comprising an internal recess proximate the nozzle wherein the internal recess receives the spout to form an acoustical seal between the spout and the nozzle.

2. The earphone assembly according to claim 1 wherein the spout further comprises an o-ring.

3. The earphone assembly according to claim 2 wherein the spout comprises a recessed portion and wherein the recessed portion receives the o-ring.

4. The earphone assembly according to claim 3 wherein the internal recess comprises a counterbore for receiving the spout and the o-ring.

5. The earphone assembly according to claim 4 wherein when the spout and the o-ring are placed into the internal recess in the nozzle radial forces act on the o-ring to maintain the acoustical seal between the spout and the outer housing.

6. The earphone assembly according to claim 1 wherein the balanced armature motor assembly comprises a paddle, and wherein the paddle is acoustically sealed inside the inner housing.

7. The earphone assembly according to claim 6 wherein the balanced armature motor assembly further comprises an armature having a flexible reed, a pole piece containing an upper magnet and a lower magnet, an armature, a bobbin surrounded by a coil, a flex board mounted to the bobbin, and a drive pin and wherein the drive pin is operatively connected between the reed and the paddle.

8. An earphone assembly comprising an inner housing containing a balanced armature motor assembly, the inner housing comprising a spout with a sound outlet; an outer housing comprising a nozzle for transmitting sound, the outer housing comprising an internal recess proximate the nozzle wherein the internal recess receives the spout to form an acoustical seal between the spout and the nozzle and wherein the spout and the nozzle form a continuous acoustically-sealed sound passage to a user's ear canal.

9. The earphone assembly according to claim 1 wherein the nozzle receives a sleeve adapted for placement into an ear canal of a user.

10. A method of forming an earphone assembly comprising:

joining an inner cover portion with a spout base portion having a spout to form an inner housing for housing a balanced armature motor assembly;

placing an o-ring onto the spout of the spout base portion;

placing at least a portion of the spout and the o-ring into an recess in a primary case portion, the primary case portion comprising a nozzle extending from the recess, the o-ring forming an acoustical seal between the spout and the nozzle;

sealing an outer cover onto the primary case portion to form an outer housing, the outer housing containing the inner housing.

11. The method according to claim 10 further comprising forming the spout with a recessed portion and placing the o-ring in the recessed portion.

12. The method according to claim 10 further comprising acoustically sealing a paddle to the spout base portion of the inner housing.

13. The method according to claim 10 further comprising placing a sleeve onto the nozzle for placement into an ear canal of a user.

14. An earphone assembly comprising:

an inner housing comprising a nozzle, configured to receive a sleeve for placement into a user's ear, and a balanced armature motor assembly, wherein the balanced armature motor assembly is mounted in the inner housing so as to form an acoustical seal between the inner housing and the balanced armature motor assembly; and an outer housing configured to receive the inner housing, wherein the nozzle of the inner housing extends through the outer housing.

15. The earphone assembly according to claim 14 wherein the inner housing comprises a nozzle base and a cover, the nozzle base and cover interconnecting to one another, wherein the nozzle extends from the nozzle base.

16. The earphone assembly according to claim 15 wherein one of the nozzle base or cover comprises a cavity housing the balanced armature motor assembly.

17. The earphone assembly according to claim 14 wherein the balanced armature motor assembly comprises an armature, a pole piece containing an upper magnet and a lower magnet, a bobbin surrounded by a coil, a flex board mounted to the bobbin, and a drive pin, wherein the drive pin is operatively connected to a paddle.

18. The earphone assembly according to claim 14 wherein the inner housing comprises a recess for receiving a paddle.

19. The earphone assembly according to claim 14 wherein the inner housing comprises at least one notch portion for receiving a pole piece.

20. An earphone assembly comprising:

an inner housing comprising a balanced armature motor assembly; wherein the balanced armature motor assembly is mounted in the inner housing so as to form an acoustical seal between the inner housing and the balanced armature motor assembly; and an outer housing comprising a nozzle configured to receive a sleeve for placement into a user's ear; wherein at least a portion of the inner housing is integrally formed together with the outer housing.

21. The earphone assembly according to claim 19 wherein the inner housing comprises a base portion formed together with the outer housing and an inner cover portion formed together with the outer housing.

22. The earphone assembly according to claim 19 wherein the inner housing comprises a lid configured to be secured to the portion of the inner housing formed together with the outer housing.

* * * * *